US012782035B2

(12) United States Patent
Kim

(10) Patent No.: US 12,782,035 B2
(45) Date of Patent: Nov. 3, 2026

(54) REFRIGERATOR

(71) Applicant: LG ELECTRONICS INC., Seoul (KR)

(72) Inventor: Jinsung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 169 days.

(21) Appl. No.: 18/142,721

(22) Filed: May 3, 2023

(65) Prior Publication Data

US 2023/0358462 A1 Nov. 9, 2023

(30) Foreign Application Priority Data

May 6, 2022 (KR) ..... 10-2022-0055917

(51) Int. Cl.
*F25D 23/02* (2006.01)
*F25D 23/10* (2006.01)
*A47B 96/20* (2006.01)

(52) U.S. Cl.
CPC ..... *F25D 23/02* (2013.01); *F25D 23/028* (2013.01); *F25D 23/10* (2013.01); *A47B 2096/208* (2013.01)

(58) Field of Classification Search
CPC ..... F25D 23/028; F25D 23/02; F25D 23/10; F25D 2400/18; A47B 2096/208
See application file for complete search history.

(56) References Cited

U.S. PATENT DOCUMENTS

| | | | | |
|---|---|---|---|---|
| 10,330,370 | B2 * | 6/2019 | Choi | A47F 3/043 |
| 11,815,304 | B2 * | 11/2023 | Lee | E06B 3/4627 |
| 11,867,450 | B2 * | 1/2024 | Lee | F25D 23/02 |
| 11,942,004 | B2 * | 3/2024 | Artwohl | A47F 3/001 |
| 2004/0222725 | A1 * | 11/2004 | Park | F25D 23/10 312/405 |
| 2009/0045705 | A1 * | 2/2009 | Laible | A47B 96/20 312/204 |
| 2017/0318965 | A1 * | 11/2017 | Hawkins | A47B 96/20 |
| 2018/0172337 | A1 * | 6/2018 | Choi | E06B 5/006 |
| 2019/0082840 | A1 * | 3/2019 | Hawkins | F25D 23/028 |
| 2020/0193881 | A1 * | 6/2020 | Artwohl | A47F 3/0434 |
| 2021/0071934 | A1 * | 3/2021 | Lee | F25D 23/028 |
| 2021/0183281 | A1 * | 6/2021 | Artwohl | A47F 3/0434 |
| 2023/0094803 | A1 * | 3/2023 | Wittes | F24C 7/085 312/330.1 |

FOREIGN PATENT DOCUMENTS

| | | | | |
|---|---|---|---|---|
| CN | 113266990 | A * | 8/2021 | F25D 23/028 |
| DE | 647821 | A1 * | 4/1995 | |
| DE | 102011007408 | A1 * | 10/2012 | F16B 5/0275 |
| DE | 102019106687 | A1 * | 5/2020 | F24C 15/08 |
| EP | 647821 | A1 * | 4/1995 | F25D 23/02 |
| EP | 2664879 | A2 * | 11/2013 | F25D 23/10 |
| KR | 10-2018-0069637 | | 6/2018 | |
| WO | WO-2025252038 | A1 * | 12/2025 | F25D 23/10 |

* cited by examiner

*Primary Examiner* — Kimberley S Wright

(74) *Attorney, Agent, or Firm* — KED & ASSOCIATES, LLP

(57) ABSTRACT

According to the present disclosure, disclosed is a refrigerator in which a first adjustment member disposed on the upper surface of a door adjusts the up-down position of a panel, and a second adjustment member disposed on the lateral surfaces of the door adjusts the left-right position of the panel, ensuring the simplification of the panel' movement mechanism for adjusting a step as well as a precise adjustment thereof.

19 Claims, 20 Drawing Sheets

DAE-0280

REFRIGERATOR

CROSS-REFERENCE TO RELATED APPLICATION

This application claims priority to and the benefit of Korean Patent Application No. 10-2022-0055917, filed on 2022 May 6, the disclosure of which is incorporated herein by reference in its entirety.

TECHNICAL FIELD

The present disclosure relates to a refrigerator in which a step of a panel disposed on the front surface of a door can be adjusted.

BACKGROUND

Refrigerators supply cold air that is generated based on the circulation of refrigerants to a storage compartment, such that various types of storage targets are kept fresh in the storage compartment for a long time.

A refrigerator comprises a cabinet that constitutes the storage compartment, and a door that connects to the front surface of the cabinet and opens and closes the storage compartment.

Since doors constituting the front surface of the cabinet forms the exterior of a refrigerator, refrigerators having a door of a variety of materials, colors and design patterns and the like, which are readily replaced according to the preferences of the user, are in high demand.

In recent years, the front surface of the door of a refrigerator, having a variety of exteriors, have been widely used, in harmony with the environments where they are placed or surrounding furniture or home appliances thereof.

For example, built-in refrigerators can constitute a wall, together with furniture or home appliances.

In the case of a built-in refrigerator, a cabinet main body is accommodated in an already designed space such as furniture, and an additional panel can be placed on the front surface of a door, for the refrigerator to harmonize with surrounding furniture or home appliances.

The environment where a built-in refrigerator is accommodated varies, and a step can be formed at a panel placed of the door.

In this context, a step adjustment structure is required to adjust a step of a panel readily and rapidly, to allow a built-in refrigerator to harmonize with surrounding environments.

Technical Problems

The objective of the present disclosure is to provide a refrigerator that ensures the simplification of a panel's precise movement mechanism for adjusting a step.

The objective of the present disclosure is to provide a refrigerator that ensures the simplification of a panel's fixation mechanism for adjusting a step.

The objective of the present disclosure is to provide a refrigerator where a twist of a panel the step of which is adjusted decreases with a simple structure.

The objective of the present disclosure is to provide a refrigerator that ensures efficiency and workability in the adjustment of a step of a panel.

The objective of the present disclosure is to provide a refrigerator in which components for adjusting a step are shared, leading to a reduction in manufacturing costs.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

In a refrigerator of one embodiment, a first adjustment member disposed on the upper surface of a door adjusts the up-down position of a panel, and a second adjustment member disposed on the lateral surfaces of the door adjusts the left-right position of the panel, ensuring the simplification of the panel' movement mechanism for adjusting a step as well as a precise adjustment thereof.

The refrigerator comprises a cabinet comprising a storage compartment, a door opening and closing a front surface of the cabinet, a panel being disposed on a front surface of the door, a plurality of adjustment members being coupled to an upper surface and lateral surfaces of the door and adjusting a position of the panel, and a coupling bracket being coupled to a rear surface of the panel and fixing the panel to the adjustment member, and the adjustment member comprises a first adjustment member being disposed on the upper surface of the door and adjusting an up-down position of the panel, and a second adjustment member being disposed on the lateral surfaces of the door and adjusting a left-right position of the panel.

In another embodiment, the coupling bracket may comprise a first bracket being disposed along an upper surface of the panel, and a pair of second brackets being disposed along both lateral surfaces of the panel, the first bracket may comprise a first fastening part bending rearward to have a surface that faces the upper surface of the door and being fixed to the first adjustment member, and the second bracket may comprise a second fastening part bending rearward to have a surface that faces a lateral surface of the door and being fixed to the second adjustment member.

In another embodiment, a first storage part and a second storage part may be disposed in the positions where the first storage part and the second storage part are symmetrical to each other, with respect to a central portion of a body assembly.

In another embodiment, the first fastening part may comprise a penetration hole which penetrates the first fastening part, and the second fastening part may comprise an insertion part which penetrates the second fastening part and a rear surface of which is open.

In another embodiment, the door may comprise a plurality of concave parts which comprises a fastening hole being coupled to one end of the adjustment member and a front surface of which is open, and the concave parts may comprise a first concave part being disposed on the upper surface of the door and being coupled to the first adjustment member, and a second concave part being disposed on the lateral surfaces of the door and being coupled to the second adjustment member.

In another embodiment, the adjustment member may comprise a mounting part on which the first fastening part or the second fastening part sits, an adjusting part being elongated in one side direction of the mounting part and being screw-coupled to the fastening hole, and a tightening part being elongated in the other side direction of the mounting part and penetrating the first fastening part or the second fastening part, and the up-down position or the left-right position of the panel may be adjusted, depending on rotation of the adjusting part.

In another embodiment, a distance moved by the tightening part penetrating the first fastening part may be limited by the penetration hole, and a distance moved by the tightening part penetrating the second fastening part may be limited by the insertion part.

In another embodiment, an inner diameter of the concave part may be greater than an outer diameter of the first fastening part and the second fastening part.

In another embodiment, an outer diameter of the tightening part may be less than an inner diameter of the penetration hole and the insertion part.

In another embodiment, the refrigerator further may comprises a nut being screw-coupled to the tightening part, a first fastening part or a second fastening part may be disposed between the mounting part and the nut, and the first fastening part and the second fastening part may be fixed by the nut.

In another embodiment, a pair of the first adjustment members may be disposed on the upper surface of the door, and a pair of second adjustment members may be disposed respectively on both lateral surfaces of the door.

In another embodiment, the pair of first adjustment members may be disposed respectively on both sides of the door, with respect to a center thereof, in a left-right direction thereof, and the pair of second adjustment members may be disposed respectively on both sides of the door, with respect to a center thereof, in an up-down direction thereof.

In another embodiment, the first adjustment member may be screw-coupled to the door in a way that the first adjustment member moves in the up-down direction of the door, and the second adjustment member may be screw-coupled to the door in a way that the second adjustment member moves in the left-right direction of the door.

In another embodiment, the first adjustment member and the second adjustment member may have the same shape.

In another embodiment, the first concave part and the second concave part may have the same shape.

In another embodiment, the first concave part and the second concave part may be disposed on the same line, along a perimeter of the door.

Advantageous Effects

In a refrigerator of the present disclosure, a first adjustment member disposed on the upper surface of a door adjusts the up-down position of a panel, and a second adjustment member disposed on the lateral surfaces of the door adjusts the left-right position of the panel, ensuring the simplification of the panel's precise up-down and left-right movement mechanism for adjusting a step.

In the refrigerator, the outer diameter of a tightening part of the adjustment member is less than the inner diameter of a penetration hole of a first fastening part and the inner diameter of an insertion part of a second fastening part, providing a margin in which the panel can move in a front-rear direction and ensuring the simplification of a front-rear movement mechanism for adjusting a step.

In the refrigerator, the tightening part and a nut of the adjustment member are screw-coupled, to fix the first fastening part and the second fastening part that are disposed between the tightening part and the nut of the adjustment member, ensuring the simplification of the panel's fixation mechanism for adjusting a step.

In the refrigerator, an interaction between the first adjustment member and the first fastening part disposed on the upper surface of the door may result in an adjustment of a front-rear step in the upper area of the panel, and an interaction between the second adjustment member and the second fastening part disposed on the lateral surfaces of the door may result in an adjustment of a front-rear step in the lower area of the panel, such that a twist of the panel the step of which is adjusted decreases with a simple structure.

In the refrigerator, in the state where a first fastening part of a first bracket is coupled and primarily fixed to the first adjustment member disposed on the upper surface of the door, a step may be adjusted, and the panel may be fixed to the door, as a second fastening part of a second bracket is coupled to the second adjustment member disposed on the lateral surfaces of the door, thereby ensuring efficiency and workability in the adjustment of a step of the panel.

In the refrigerator, the first adjustment member and a first concave part disposed on the upper surface of the door have the same shapes as the second adjustment member ad a second concave part disposed on the lateral surfaces of the door, making it possible to share components for adjusting a step of the panel and reduce manufacturing costs significantly.

Specific effects are described along with the above-described effects, in the section of detailed description.

BRIEF DESCRIPTION OF DRAWINGS

The accompanying drawings constitute a part of the specification, illustrate one or more embodiments in the disclosure, and together with the specification, explain the disclosure, wherein.

DETAILED DESCRIPTION

Figure 1:
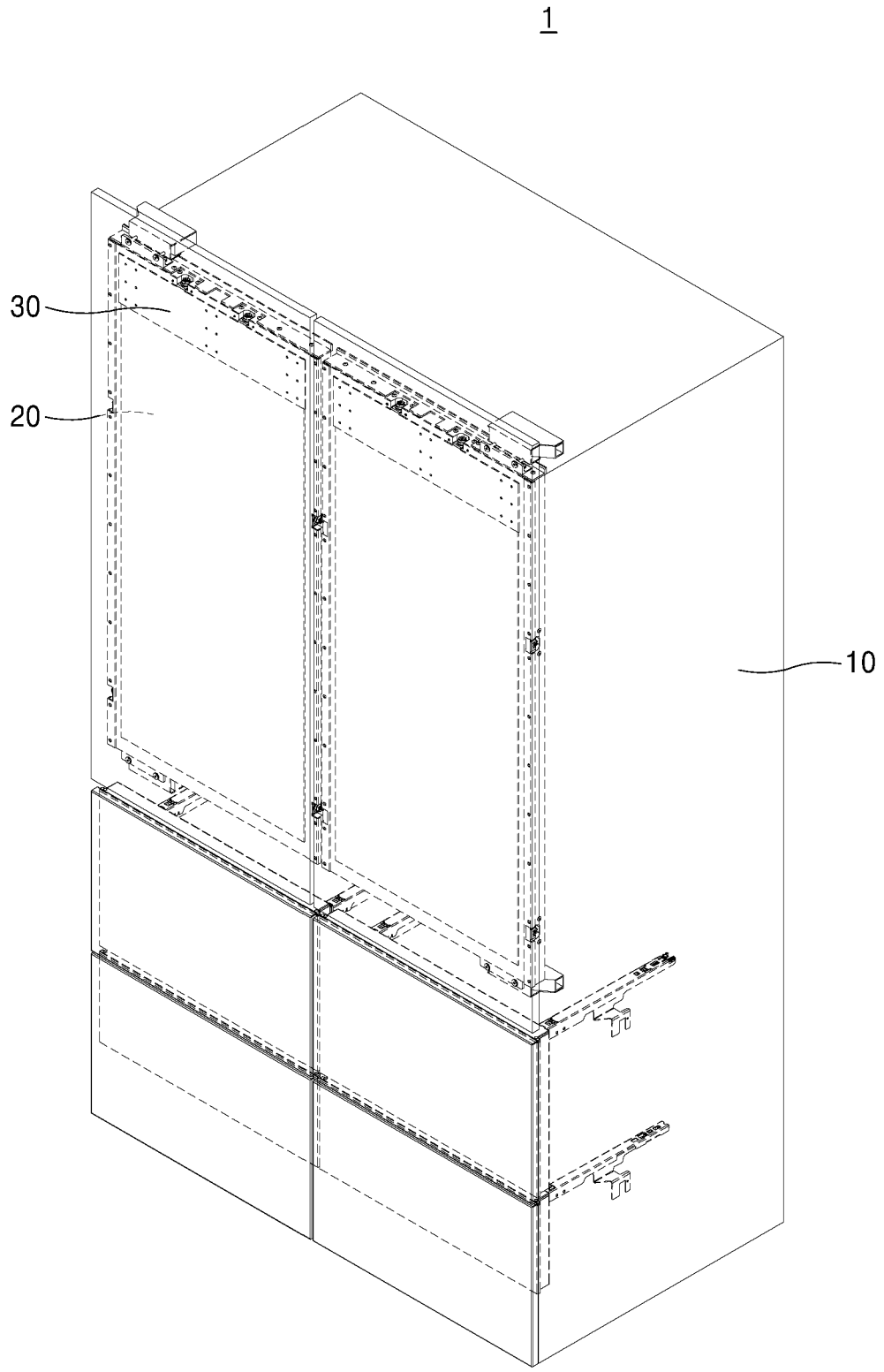
FIG. 1 is a front perspective view showing a refrigerator in the present disclosure.

The above-described aspects, features and advantages are specifically described hereafter with reference to accompanying drawings such that one having ordinary skill in the art to which the present disclosure pertains can embody the technical spirit of the disclosure easily. In the disclosure, detailed description of known technologies in relation to the subject matter of the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component, unless stated to the contrary.

Throughout the disclosure, each component can be provided as a single one or a plurality of ones, unless explicitly stated to the contrary.

When one component is described as being "in the upper portion (or lower portion)" or "on (or under)" another component, one component can be directly on (or under) another component, and an additional component can be interposed between the two components.

When any one component is described as being "connected", "coupled", or "connected" to another component, any one component can be directly connected or coupled to another component, but an additional component can be "interposed" between the two components or the two components can be "connected", "coupled", or "connected" by an additional component.

The singular forms "a", "an" and "the" are intended to include the plural forms as well, unless explicitly indicated otherwise. It is to be understood that the terms "comprise" or "include" and the like, set forth herein, are not interpreted as necessarily including all the stated components or steps but can be interpreted as excluding some of the stated components or steps or can be interpreted as including additional components or steps.

The singular forms "a", "an" and "the" are intended to include the plural forms as well, unless explicitly indicated otherwise. It is to be understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Hereafter, a refrigerator in several embodiments is described.

Figure 2:
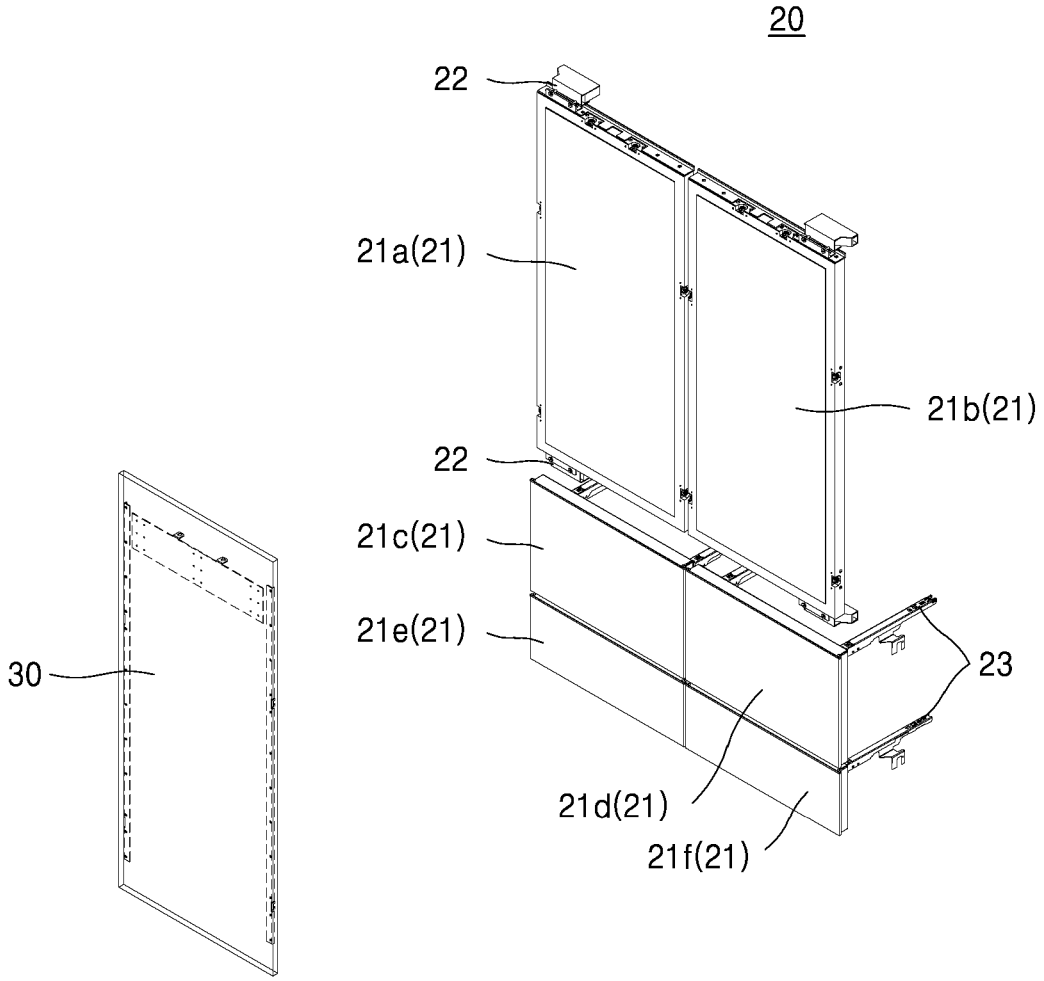
FIG. 2 is a front perspective view showing a panel assembly and a door assembly.

Referring to FIGS. 1 and 2, the exterior of a refrigerator 1 may be formed by a cabinet 10 that has a storage compartment as a storage space, therein, and a door assembly 20 that can open and close an open front surface of the cabinet 10.

The cabinet 10 may be shaped into a box the front surface of which is open, and divided into one or more storage spaces that comprise a refrigerator compartment and/or a freezer compartment.

A door assembly 20 may comprise one or more doors 21, and open and close the refrigerator compartment and/or the freezer compartment.

For example, a pair of rotary type doors 21 comprising a first door 21*a* and a second door 21*b* is disposed in the upper portion of the refrigerator 1 and is rotated by a hinge 22, to open and close the refrigerator compartment.

Additionally, drawer type doors 21 comprising a third door 21*c*, a fourth door 21*d*, a fifth door 21*e* and a sixth door 21*f* are disposed in the lower portion of the refrigerator 1 and is inserted and withdrawn by a rail 23, to open and close the freezer compartment.

A panel assembly 30 may be disposed on the front surface of each door 21 and form the exterior of the front surface of the refrigerator 1.

In the case of a built-in refrigerator, a step of the panel assembly 30 needs to be adjusted in various directions such as the up-down direction, the left-right direction and the front-rear direction, such that the built-in refrigerator is in harmony with an existing environment.

In particular, in the case of a door such as the first door 21*a* and the second door 21*b* that have an up-down width much greater than a left-right width, the verticality of the panel assembly 30 needs to be adjusted in addition to the step, considering a twist of the panel assembly 30.

Hereafter, a step adjustment structure that ensures excellent workability in the step adjustment of the panel assembly 30 and adjusts the verticality of the panel assembly 30 affected by a twist of the panel assembly 30 is described specifically with reference to FIGS. 3 to 20.

In the present disclosure, the second door 21*b* and the panel assembly 30 disposed on the front surface of the second door 21*b* are described. However, the shape or the position of a door to which the panel assembly 30 is applied is not limited. The panel assembly 30 may be applied to a door in various shapes or in various positions.

Figure 3:
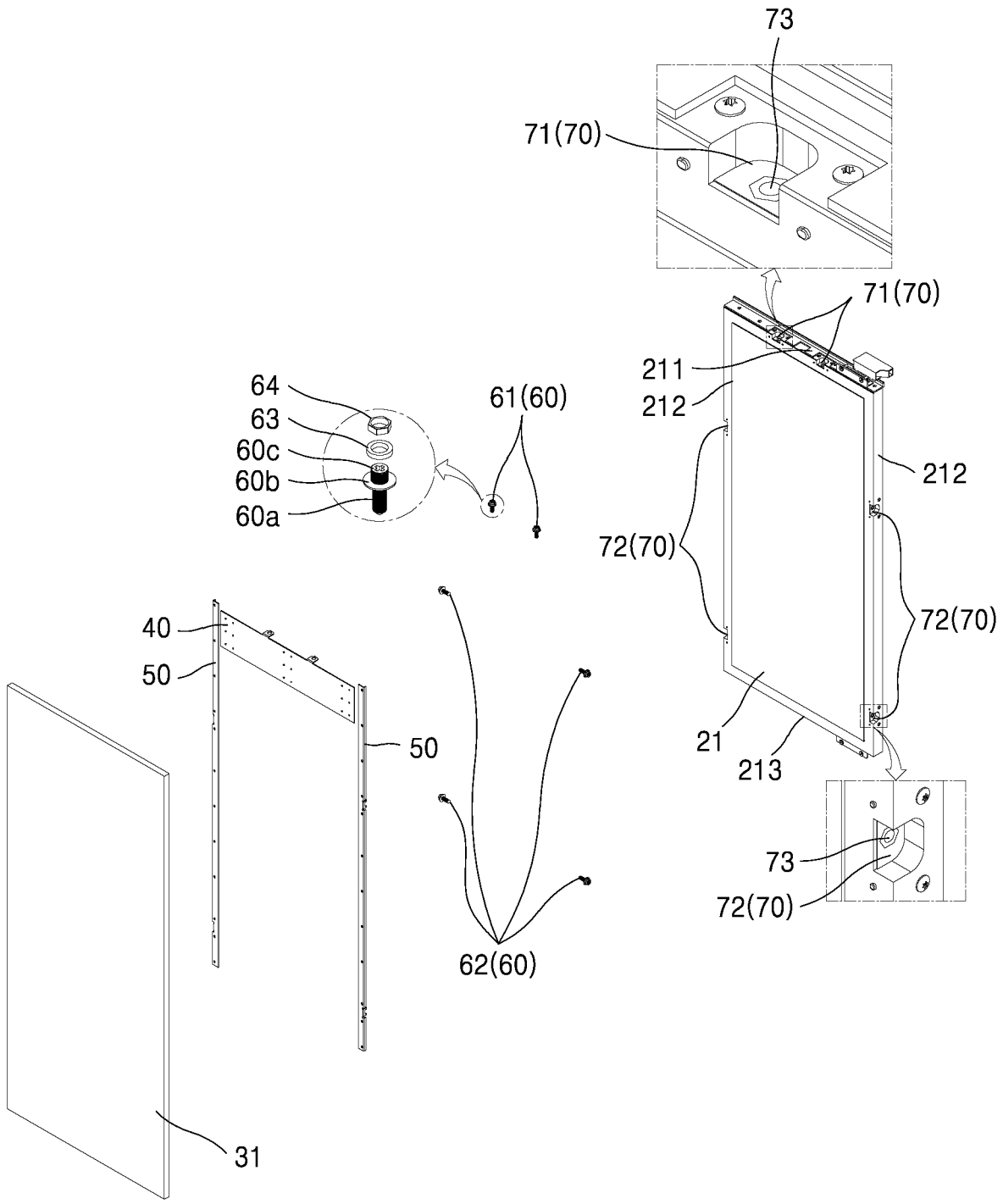
FIG. 3 is an exploded perspective view showing the panel assembly and the door assembly.
Figure 4:
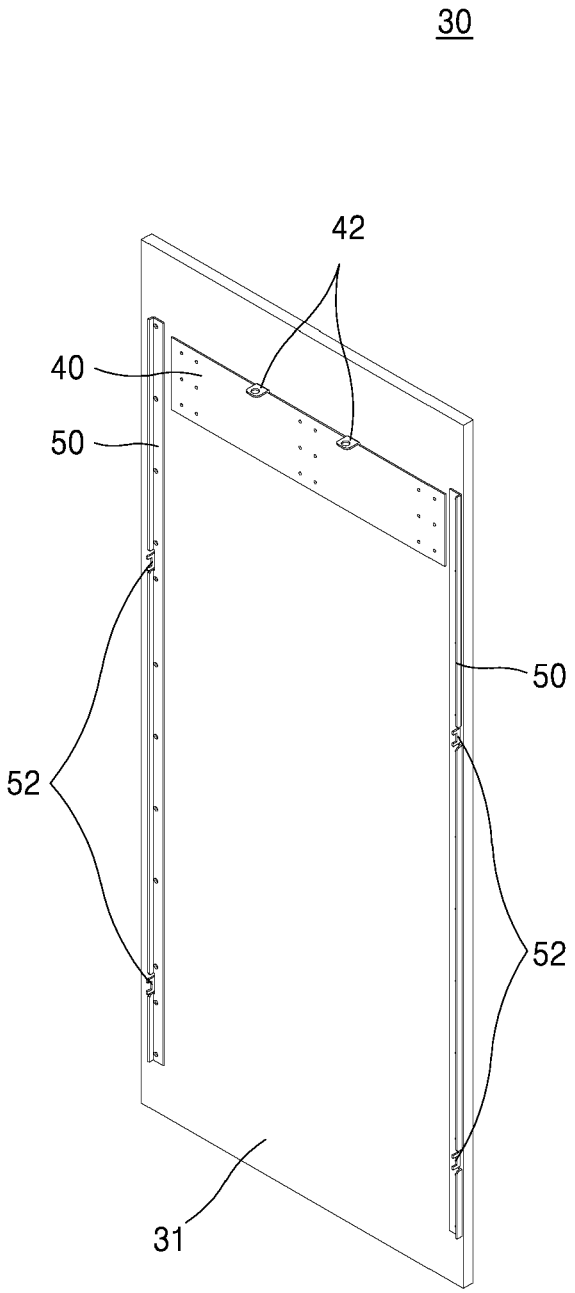
FIG. 4 is a rear perspective view showing the door assembly.
Figure 5:
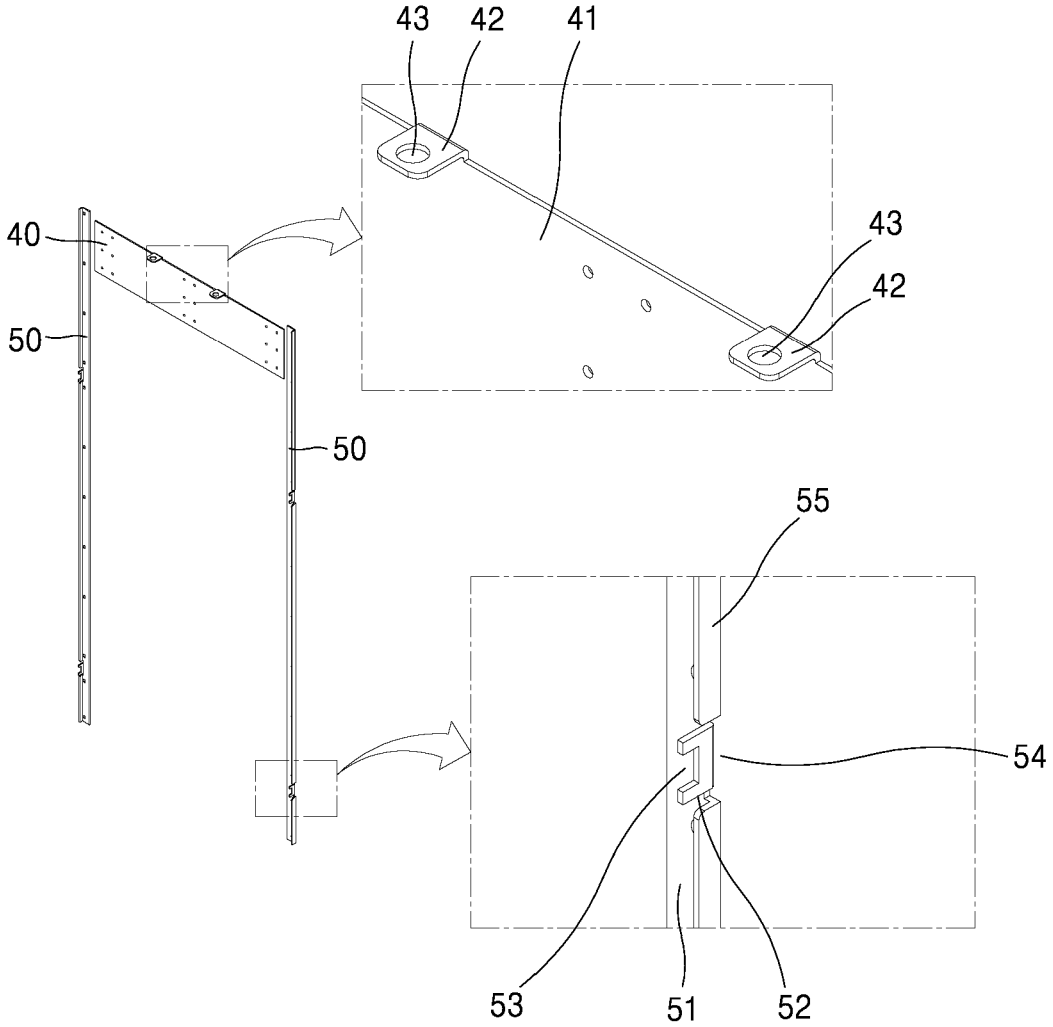
FIG. 5 is an enlarged view showing a first bracket and a second bracket.

Referring to FIGS. 3 to 5, a panel assembly 30 may comprise a panel 31 and coupling brackets 40, 50 that are disposed on the rear surface of the panel 31, be disposed on the front surface of the door 21, and be fixedly coupled to the front surface of the door 21.

The coupling brackets 40, 50 are coupled to the rear surface of the panel 31, based on a screw coupling, and fix the panel 31 to the door assembly 20.

The coupling brackets 40, 50 may comprise a first bracket 40 that is disposed along the upper surface of the panel 31 in the upper area thereof, and a pair of second brackets 50 that is disposed and elongated in the up-down direction along both lateral surfaces of the panel 31.

The upper end of the first bracket 40 is spaced inward from the upper end of the panel 31 by a predetermined distance, and the lateral ends of the second bracket 50 are spaced inward from the lateral ends of the panel 31 by a predetermined distance.

Accordingly, a marginal area may be provided to sufficiently cover the upper portion and the lateral portions of the door assembly 20 disposed at the rear of the panel 31, even when the panel 31 is moved based on the step adjustment.

The first bracket 40 may comprise a first body part 41 that is elongated along the left-right direction of the panel 31, and a pair of first fastening parts 42 that bends rearward from the upper end of the first body part 41.

The first body part 41 substantially withstands the weight of the panel 31.

To this end, the first body part 41 may be formed to have an up-down width, to prevent the first bracket 40 and the panel 31 coupled from escaping from each other and to couple the first bracket 40 and the panel 31 sufficiently, and be firmly fixed to the rear surface of the panel 31 by a plurality of screw-coupling members.

The pair of first fastening parts 42 is disposed in a symmetrical position and in a symmetrical shape, respectively at both sides of the panel 31, with respect to the center of the panel 31, in the left-right direction thereof, to maintain the balance of the panel 31, at a time of fixing the panel 31.

The first fastening part 42 may be formed in a way that the first fastening part 42 bends in a direction perpendicular to the first body part 41 and bends to have a surface that faces the upper surface of the door 21 in parallel.

The first fastening part 42 may comprise a penetration hole 43 that penetrates the first fastening part 42.

Accordingly, the penetration hole 43 may also be formed to have a surface that faces the upper surface of the door 21 in parallel.

The second bracket 50 may comprise a second body part 51 that is elongated along the up-down direction of the panel 31, and a pair of second fastening parts 52 that bends rearward from the lateral ends of the second body part 51.

The left-right width of the second body part 51 may be less than the up-down width of the first body part 41, and the second body part 51 may be firmly fixed to the rear surface of the panel 31 by a plurality of screw fastening members.

The pair of second fastening parts 52 may be disposed respectively at both sides of the panel 31, with respect to the center thereof, in the up-down direction thereof, and assist with the adjustment of the step in the upper area and the lower area of the panel 31, and the adjustment of verticality of the panel 31.

The second fastening part 52 may be formed in a way that the second fastening part 52 bends in a direction perpendicular to the second body part 51 and bends to have a surface that faces a lateral surface of the door 21 in parallel.

The second fastening part 52 may comprise an insertion part 53 which penetrates the second fastening part 52 and the rear surface of which is open.

For example, the insertion part 52 may have a "EC" shape where a surface facing the door 21 is open.

Accordingly, the insertion part 53 may also be formed to have a surface that faces a lateral surface of the door 21 in parallel.

The second bracket 50 may comprise a bend part 55 that is formed in a way that the second bracket 50 bends rearward along a lateral end of the second body part 51.

The bend part 55 may be elongated in the up-down direction, except for a portion where the second fastening part 52 is disposed.

The bend part 55 may help to improve the rigidity of the second body part 51 having a narrow left-right width, and serve as a finish on the lateral surface where the panel 31 and the door 21 are coupled.

The insertion part 53 may protrude further rearward than the bend part 55, and as the insertion part 53 is coupled to an adjustment member 60 described hereafter, may not be interfere with by the bend part 55.

The insertion part 53 may be formed further inward than the bend part 55, with respect to a lateral end of the second body part 51.

Since the insertion part 53 is formed further inward than the bend part 55 as described above, a spaced part 54 as a vacant space may be formed outside the insertion part 53.

The spaced part 54 may provide a space in which a portion of the adjustment member 60 described hereafter or a fastening member such as a nut 64 is disposed, and prevent fastening members from protruding to the outside of the bend part 55.

A pair of first concave parts 71 may be disposed on an upper surface 211 of the door 21.

The first concave part 71 may form a space that is depressed toward the inside of the door and has a predetermined depth, and the front surface and the upper surface of the first concave part 71 may be open.

The pair of first concave parts 71 may be disposed in a symmetrical position and in a symmetrical shape, respectively at both sides of the door 21, with respect to the center thereof, in the left-right direction thereof.

Specifically, the first concave part 71 may be disposed in a position corresponding to the position of the first fastening part 42, such that the pair of first fastening parts 42 of the first bracket 40 is inserted respectively into the pair of first concave parts 71.

The first fastening part 42 may be inserted into the first concave part 71 through an open front surface and an open upper surface of the first concave part 71.

The inner diameter of the first concave part 71 may be greater than the outer diameter of the first fastening part 42, such that the first fastening part 42 freely moves in the first concave part 71, in the up-down direction, the left-right direction and the front-rear direction.

Accordingly, the outer circumferential surface of the first fastening part 42 may be spaced a predetermined distance apart from the inner circumferential surface of the first concave part 71.

The inner diameter of the first concave part 71 may substantially correspond to a movement restriction distance at which the movement of the first fastening part 42 is restricted.

Accordingly, in the case where the first fastening part 42 is moved to one side to a maximum degree and fixed, the inner circumferential surface of the first concave part 71 and the outer circumferential surface of the first fastening part 42 may contact each other, without being spaced from each other.

A fastening hole 73 may be disposed on the bottom surface of the first concave part 71 and coupled to one end of the adjustment member 60 described hereafter.

The fastening hole 73 may be shaped into a fastening hole having a screw thread therein, such that the adjustment member 60 having a screw thread is inserted into and fixed to the fastening hole 73, based on a screw coupling.

The fastening hole 73 may be formed in the central portion of the bottom surface of the first concave part 71, and elongated in the up-down direction and inserted into the door 21 in a way that the fastening hole 73 is exposed to the outside in a direction of the upper surface of the door 21, while not being exposed to the outside in a direction of the front surface of the door 21.

A pair of second concave parts 72 may be disposed on a lateral surface 212 of the door 21.

The second concave part 72 may form a space that is depressed toward the inside of the door and has a predetermined depth, and the front surface and the lateral surface of the second concave part 72 may be open.

The pair of second concave parts 72 may be disposed respectively at both sides of the door 21, with respect to the center thereof, in the up-down direction thereof.

Specifically, the second concave part 72 may be disposed in a position corresponding to the position of the second fastening part 52, such that the pair of second fastening parts 52 of the panel 31 is inserted respectively into the pair of second concave parts 72.

The second fastening part 52 may be inserted into the second concave part 72 through an open front surface and an open lateral surface of the second concave part 72.

The inner diameter of the second concave part 72 may be greater than the outer diameter of the second fastening part 52, such that the second fastening part 52 is freely moved in the second concave part 72, in the up-down direction, the left-right direction and the front-rear direction.

Accordingly, the outer circumferential surface of the second fastening part 52 may be spaced a predetermined distance apart from the inner circumferential surface of the second concave part 72.

The inner diameter of the second concave part 72 may substantially correspond to a movement restriction distance at which the movement of the second fastening part 52 is restricted.

Thus, in the case where the second fastening part 52 is moved to one side to a maximum degree and fixed, the inner circumferential surface of the second concave part 72 and the outer circumferential surface of the second fastening part 52 may contact each other without being spaced from each other.

A fastening hole 73 may be disposed on one side surface of the second concave part 72 and coupled to the adjustment member 60 described hereafter.

The fastening hole 73 may be formed into a fastening hole having a screw thread therein, such that the adjustment member 60 having a screw thread is inserted into ad fixed to the fastening hole 73, based on a screw coupling.

The fastening hole 73 may be formed in the central portion of one side surface of the second concave part 72, and elongated in the left-right direction and inserted into the door 21 in a way that the fastening hole 73 is exposed to the outside in a direction of a lateral surface of the door 21, while not being exposed to the outside in the direction of the front surface of the door 21.

Since the door 21 has a pair of lateral surfaces comprising one lateral surface and the other lateral surface, the pair of second concave parts 72 may be disposed on one lateral surface of the door 21, and the pair of second concave parts 72 may also be disposed on the other lateral surface of the door 21.

Accordingly, each pair of the second concave parts 72 disposed on one lateral surface and the other lateral surface of the door with respect to the left-right direction may be disposed symmetrically on the same line.

The first concave part 71 and the second concave part 72 may have substantially the same shape except for the directions in which the first concave part 71 and the second concave part 72 are open.

Further, the first concave part 71 and the second concave part 72 may be disposed on the same line, along the perimeter of the door 21.

Since the first concave part 71 and the second concave part 72 have the same shape and are disposed on the same line, as described above, components for constituting the first concave part 71 and the second concave part 72 may be shared, resulting in a significant reduction in manufacturing costs.

A plurality of adjustment members 60 may be coupled to and disposed on the upper surface 211 and the lateral surface 212 of the door 21, and respectively adjust the position of the panel 31.

That is, an additional adjustment member 60 does not need to be disposed on a lower surface 213 of the door 21, and a plurality of adjustment members 60 disposed on the upper surface 211 and the lateral surfaces 212 of the door 21 may be used to adjust the position of the panel 31.

The adjustment member 60 may fix the coupling brackets 40, 50 coupled to the rear surface of the panel 31 to the door 21.

The adjustment member 60 may comprise a first adjustment member 61 that is disposed on the upper surface 211 of the door 21 and adjusts the up-down (a) position of the panel 31, and a second adjustment member 62 that is disposed on the laterals surface 212 of the door 21 and adjusts the left-right (b) position of the panel 31

A pair of first adjustment members 61 may be provided and coupled respectively to the fastening hole 73 of the pair of first concave parts 71 that is disposed on the upper surface 211 of the door 21, and a pair of second adjustment members 62 may be provided and coupled respectively to the fastening hole 73 of the pair of second concave parts 72 that is respectively disposed on both the lateral surfaces 212 of the door 21.

Accordingly, the first adjustment member 61 may be disposed respectively at both sides of the door 21, with respect to the center thereof, in the left-right direction thereof, such that the position of the first adjustment member 61 corresponds to the position of the first concave part 71, and the second adjustment member 62 may be disposed at both sides of the door 21, with respect to the center thereof, in the up-down direction thereof, such that the position of the second adjustment member 62 corresponds to the position of the second concave part 72.

Since the first adjustment member 61 and the second adjustment member 62 are formed as the same component having substantially the same shape, except for the position and direction of the couplings of the first adjustment member 61 and the second adjustment member 62, the first adjustment member 61 and the second adjustment member 62 may be shared, resulting in a reduction in manufacturing costs.

The adjustment member 60 may comprises an adjusting part 60*a* formed at one end thereof, a tightening part 60*c* formed at the other end thereof, and a mounting part 60*b* formed between the adjusting part 60*a* and the tightening part 60*c*.

The first fastening part 42 or the second fastening part 52 may be mounted on the mounting part 60*b*.

To this end, the mounting part 60*b* may be elongated in a way that the mounting part 60*b* has a surface parallel with the surface on which the first fastening part 42 and the second fastening part 52 are mounted.

For example, the mounting part 60*b* may be shaped into a circular plate but not limited.

The adjusting part 60*a* may be elongated in a way that the adjusting part 60*a* has a screw thread in a direction of one side of the mounting part 60*b*, and be screw-coupled to the fastening hole 73.

The outer diameter of the adjusting part 60*a* may be less than the outer diameter of the mounting part 60*b*.

The tightening part 60*c* may be elongated in a way that the tightening part 60*c* has a screw thread in a direction of the other side of the mounting part 60*b*, and a nut 64 may be screw-coupled to the tightening part 60*c*.

The tightening part 60*c* may pass through the penetration hole 43 of the first fastening part 42, and the first fastening part 42 may be disposed between the tightening part 60*c* and the nut 64, and fixed as the nut 64 is tightened.

A washer 63 may be additionally disposed between the nut 64 and the first fastening part 42, to reduce the possibility of damage and increase frictional force at a time when the nut 64 and the first fastening part 42 are coupled.

Additionally, the tightening part 60*c* may pass through the insertion part 53 of the second fastening part 52, and the second fastening part 52 may be disposed between the tightening part 60*c* and the nut 64, and fixed as the nut 64 is tightened.

A washer 63 may be additionally disposed between the nut 64 and the second fastening part 52, to reduce the possibility of damage and increase frictional force at a time when the nut 64 and the second fastening part 52 are coupled.

As described above, in the refrigerator 1 of the present disclosure, since the tightening part 60*c* and the nut 64 of the adjustment member 60 are screw-coupled to fix the first fastening part 42 and the second fastening part 52 that are disposed between the tightening part 60*c* and the nut 64, ensuring the simplification of a panel's fixation mechanism for adjusting a step.

Figure 6:
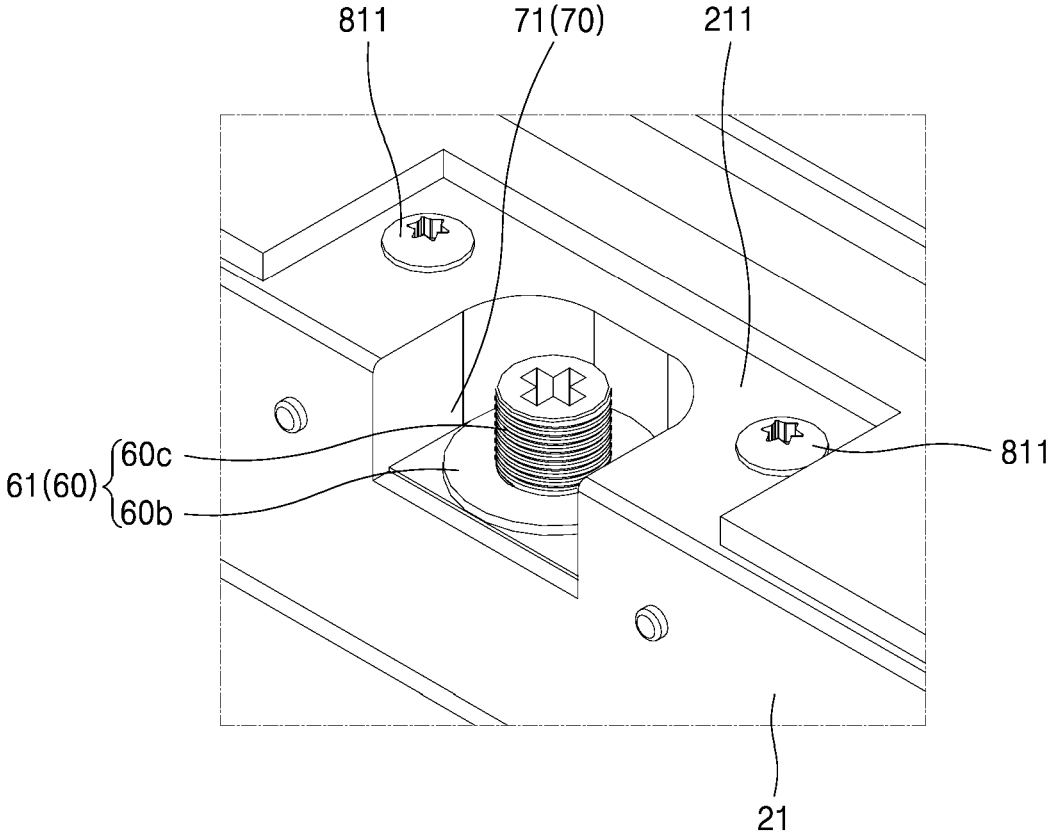
FIG. 6 is an enlarged view showing that a first adjustment member is coupled to a fastening hole disposed on the upper surface of a door.
Figure 7:
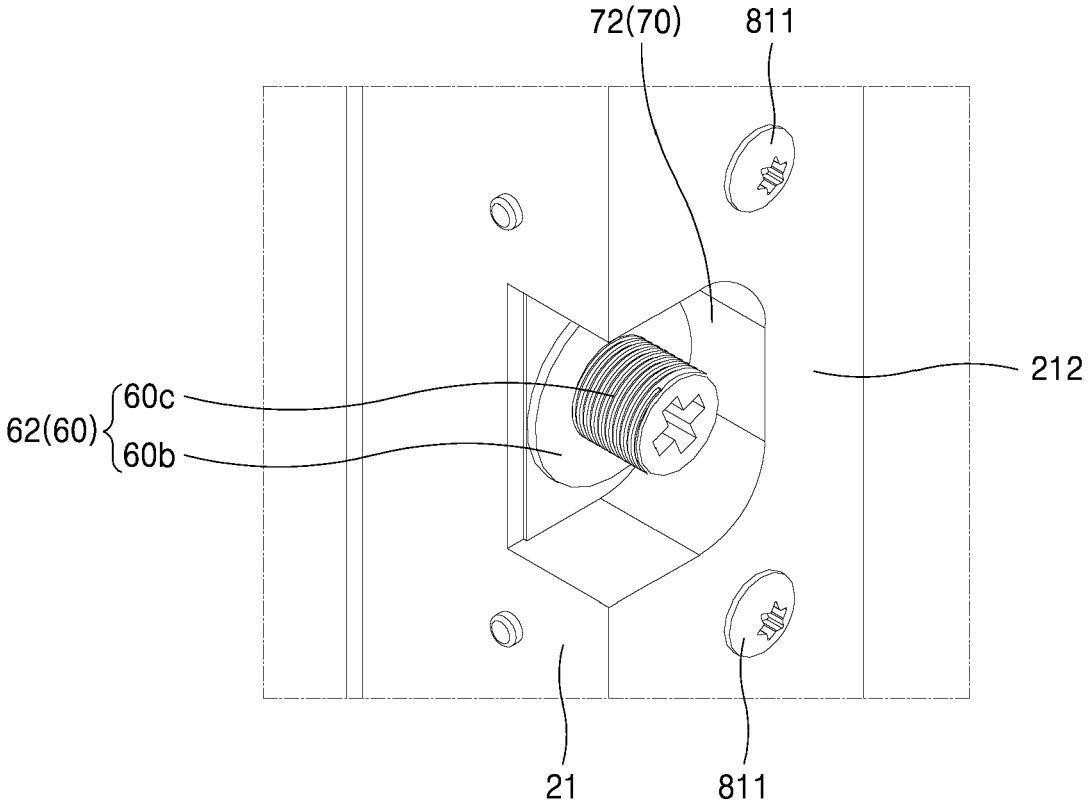
FIG. 7 is an enlarged view showing that a second adjustment member is coupled to a fastening hole disposed on a lateral surface of the door.

FIG. 6 and FIG. 7 are respectively a view showing that the adjusting part 60*a* of the first adjustment member 61 is screw-coupled to the fastening hole 73 of the first concave part 71, and a view showing that the adjusting part 60*a* of the second adjustment member 62 is screw-coupled to the fastening hole 73 of the second concave part 72.

As described above, the adjusting parts 60*a* of the first adjustment member 61 and the second adjustment member 62 may be screw-coupled to the fastening holes 73 that are respectively formed on the upper surface 211 and the lateral surfaces 212 of the door 21, and depending on a direction of the rotation of the screw, the height of the first adjustment member 61 and the height of the second adjustment member 62 may be adjusted.

The first adjustment member 61 may be screw-coupled to the door 21 in a way that the first adjust member 61 can move in the up-down direction (a) of the door 21, and the second adjustment member 62 may be screw-coupled to the door 21 in a way that the second adjustment member 62 can move in the left-right direction (b) of the door 21.

Accordingly, the first fastening part 42 and the second fastening part 52 mounted on the mounting parts 60*b* of the first adjustment member 61 and the second adjustment member 62 may move in association with the adjustment of the height of the adjusting part 60*a*.

Figure 8:
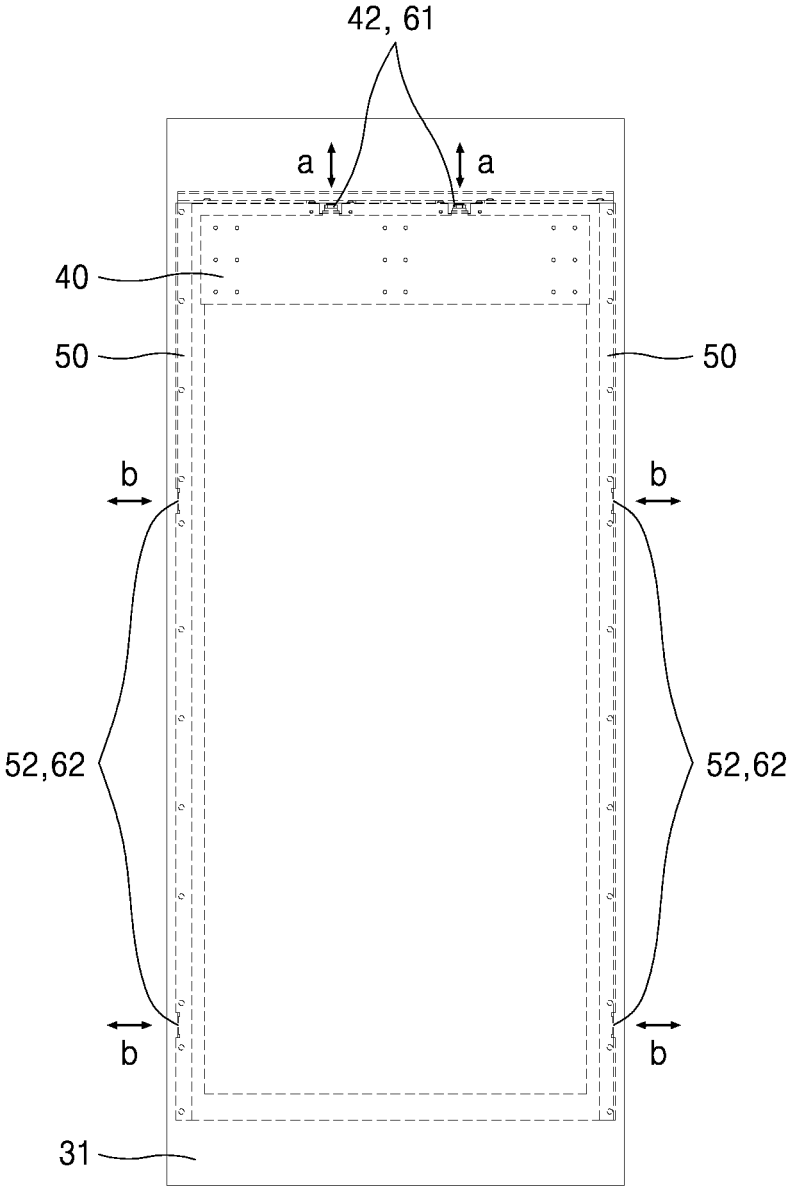
FIG. 8 is a front view showing the door to which the panel assembly is coupled.

As illustrated in FIG. 8, the panel 31 coupled to the first fastening part 42 and the second fastening part 52 may also move in association with the adjustment of the height of the adjusting part 60*a*.

That is, the up-down (a) position or the left-right (b) position of the panel 31 may be adjusted depending on the rotation direction of the adjusting part 60*a* and the number of rotations of the adjusting part 60*a*.

As described above, in the refrigerator 1 of the present disclosure, the up-down (a) position of the panel 31 may be very precisely adjusted based on the rotation of the adjusting part 60*a* of the first adjustment member 61, and the left-right (b) position of the panel 31 may be very precisely adjusted based on the rotation of the adjusting part 60*a* of the second adjustment member 62. Accordingly, a panel 31's precise up-down and left-right movement mechanism for adjusting a step may be simplified.

Figure 9:
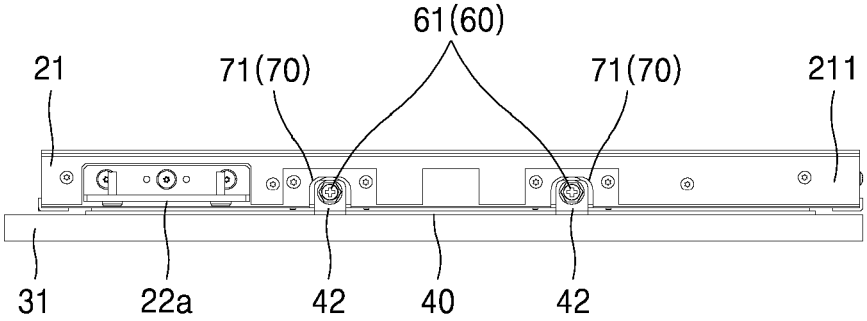
FIG. 9 is a top view showing the door.
Figure 10:
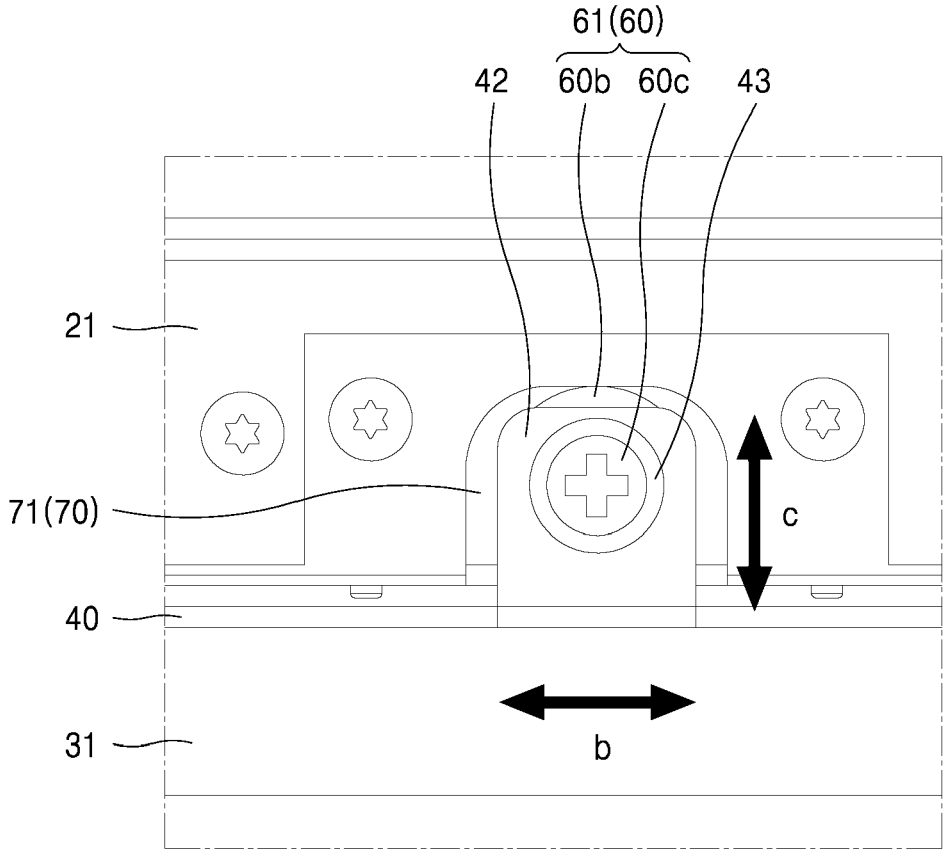
FIG. 10 is a top view showing that a first fastening part sits on the first adjustment member.

The left-right (b) movement and the front-rear movement (c) of the panel 31, on the upper surface 211 of the door 21, in association with the first adjustment member 61 and the first fastening part 42 are additionally described with reference to FIGS. 9 to 11.

The panel 31 may be coupled downward from above such that the pair of first fastening parts 42 respectively sits in the first concave part 71, on the upper surface 211 of the door 21.

Since the position of a hinge bracket 22*a* fixing the hinge 22 changes based on the rotation direction of the door 21, the hinge bracket 22*a* may be disposed outside the first concave part 71 of the door 21, to prevent the hinge 22 or the hinge bracket 22*a* from interfering with a coupling between the first fastening part 42 and the first concave part 71.

The position of the tightening part 60*c* of the first adjustment member 61 may be adjusted to allow the tightening part 60*c* to pass through the penetration hole 43 of the first fastening part 42, such that the first fastening part 42 sits on the mounting part 60*b* of the first adjustment member 61.

Since the tightening part 60*c* of the first adjustment member 61 is inserted into the penetration hole 43 of the first fastening part 42, the escape of the panel 31 may be primarily prevented, as long as the first fastening part 42 sits on the first adjustment member 61.

Thus, a precise step adjustment is performed later, with no need to support the lower portion of the panel 31 additionally, ensuing improvement in workability.

Since the outer diameter of the tightening part 60*c* is less than the inner diameter of the penetration hole 43, the tightening part 60*c* may move in the left-right direction (b) and the front-rear direction (c), in the penetration hole 43.

The left-right (b) movement of the tightening part 60*c* may be adjusted in association with the rotation of the second adjustment member 62 disposed on the lateral surfaces of the door 21.

The front-rear (c) movement of the tightening part 60*c* may not be associated with an additional member, but be adjusted as the worker moves the panel 31 in the front-rear direction (c).

At this time, since the penetration hole 43 is shaped into a closed hole, a distance moved by the tightening part 60*c* may be limited to a length corresponding to the inner diameter of the penetration hole 43.

Figure 11:
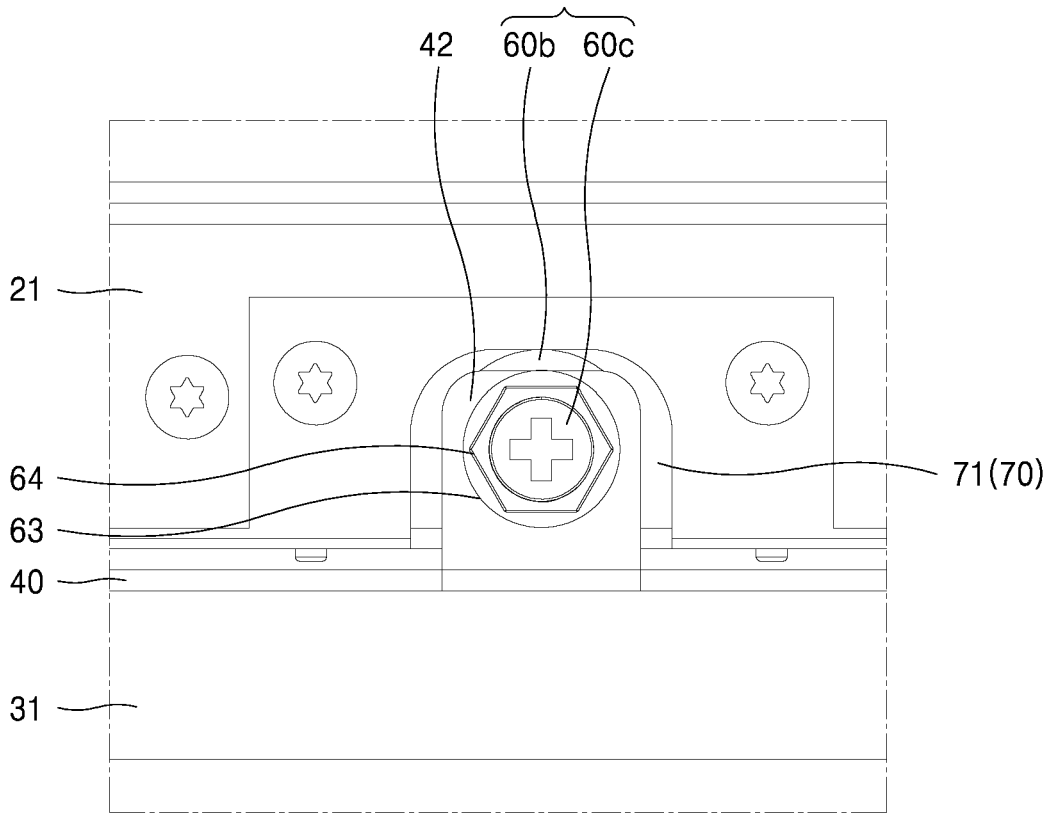
FIG. 11 is a top view showing that a nut is assembled to the first adjustment member, such that the first fastening part is fixed to the first adjustment member.
Figure 12:
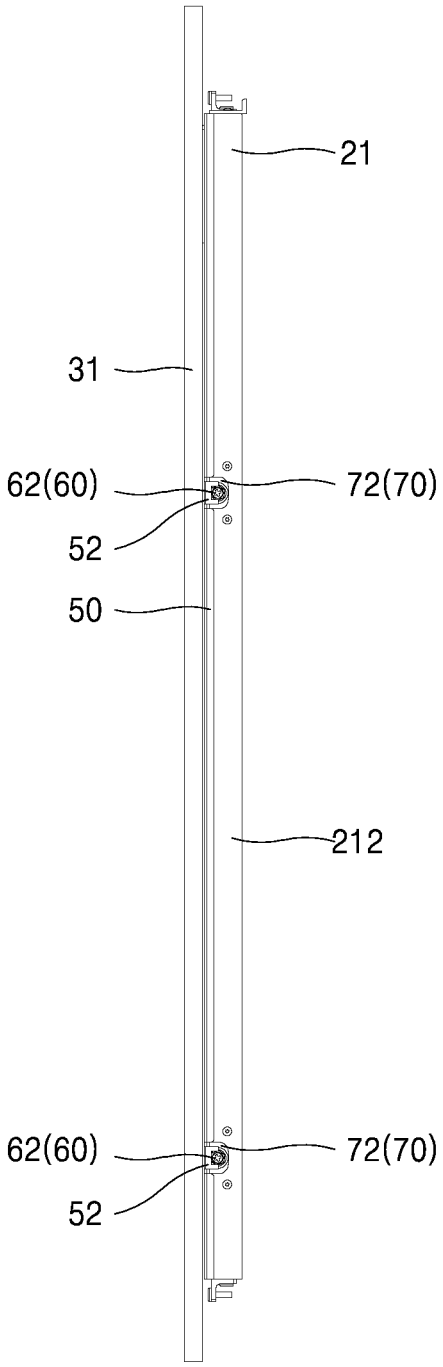
FIG. 12 is a side view showing the door.
Figure 13:
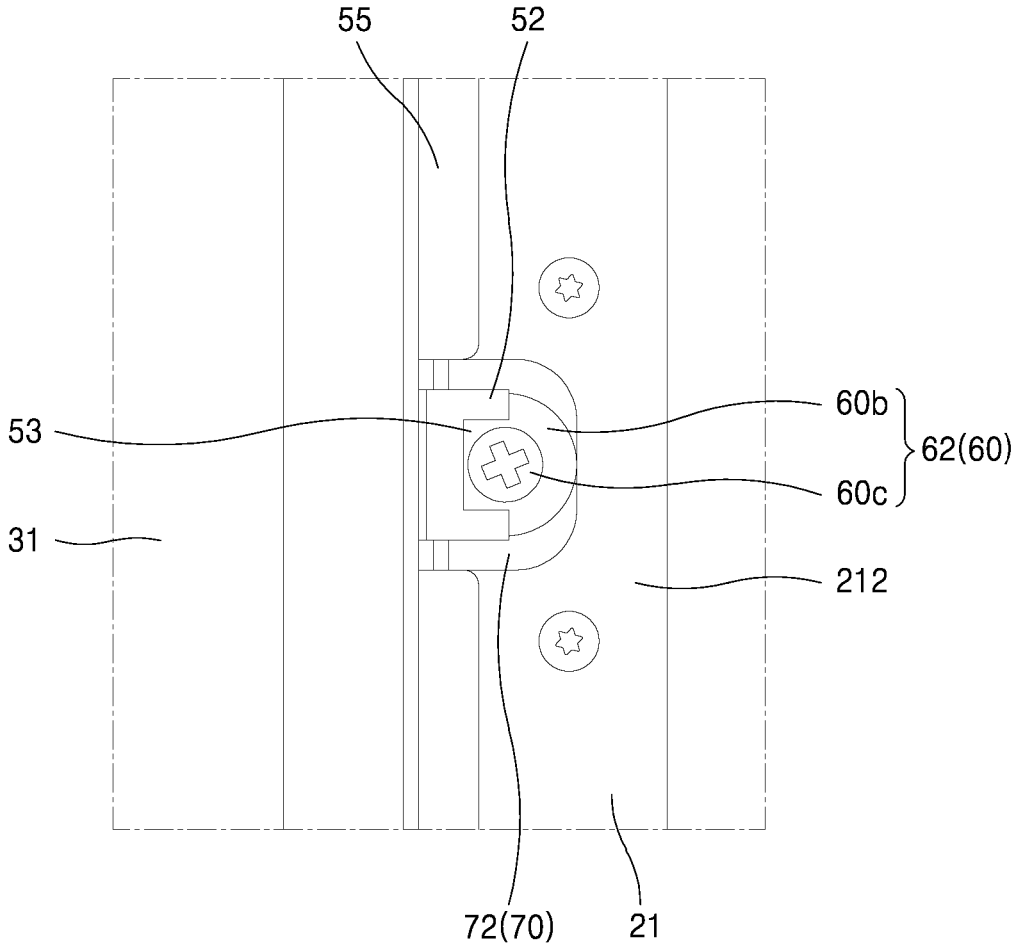
FIG. 13 is a side view showing that a second fastening part sits on the second adjustment member.

Since the tightening part 60*c* is screw-coupled to the washer 63 by the nut 64 as illustrated in FIG. 11, after the up-down (a), left-right (b) and front-rear (c) positions of the panel 31 are adjusted, the first fastening part 42 and the first adjustment member 61 are fixedly coupled, and the panel 31 may be fixed to the upper surface 211 of the door 21.

As described above, in the refrigerator 1 of the present disclosure, the outer diameter of the tightening part 60*c* of the adjustment member 60 may be less than the inner diameter of the penetration hole 43 of the first fastening part 42, providing a margin where the panel 31 may move in the front-rear direction. Thus, a front-rear movement mechanism for adjusting a step may be simplified.

The left-right (b) movement and the up-down (a) movement of the panel 31, in association with the second adjustment member 62 and the second fastening part 52 on the lateral surfaces 212 of the door 21, are additionally described with reference to FIGS. 12 to 20.

The panel 31 may be coupled from the front surface direction of the door 21 toward the rear surface direction of the door 21, such that the pair of second fastening parts 52 respectively sits in the second concave part 72, on the lateral surfaces 212 of the door 21.

Since the rear surface of the insertion part 53 of the second fastening part 52 is open, the tightening part 60*c* of the second adjustment member 62 may be inserted into the insertion part 52 in a way that the tightening part 60*c* passes through the insertion part 53 through the open rear surface of the insertion part 53.

The position of the tightening part 60*c* of the second adjustment member 62 may be adjusted to allow the tightening part 60*c* to pass through the insertion part 53 of the second fastening part 52, such that the second fastening part 52 is disposed on the lateral surface of the mounting part 60*b* of the second adjustment member 62.

Depending on the degree to which the adjusting part 60*a* of the second adjustment member 62 is inserted into the inside of the door 21, the second fastening part 52 may be spaced a predetermined distance apart from the mounting part 60*b* or contact the mounting part 60*b*.

A distance moved by the tightening part 60*c* may be limited to a length corresponding to the inner diameter of the insertion part 53.

Figure 14:
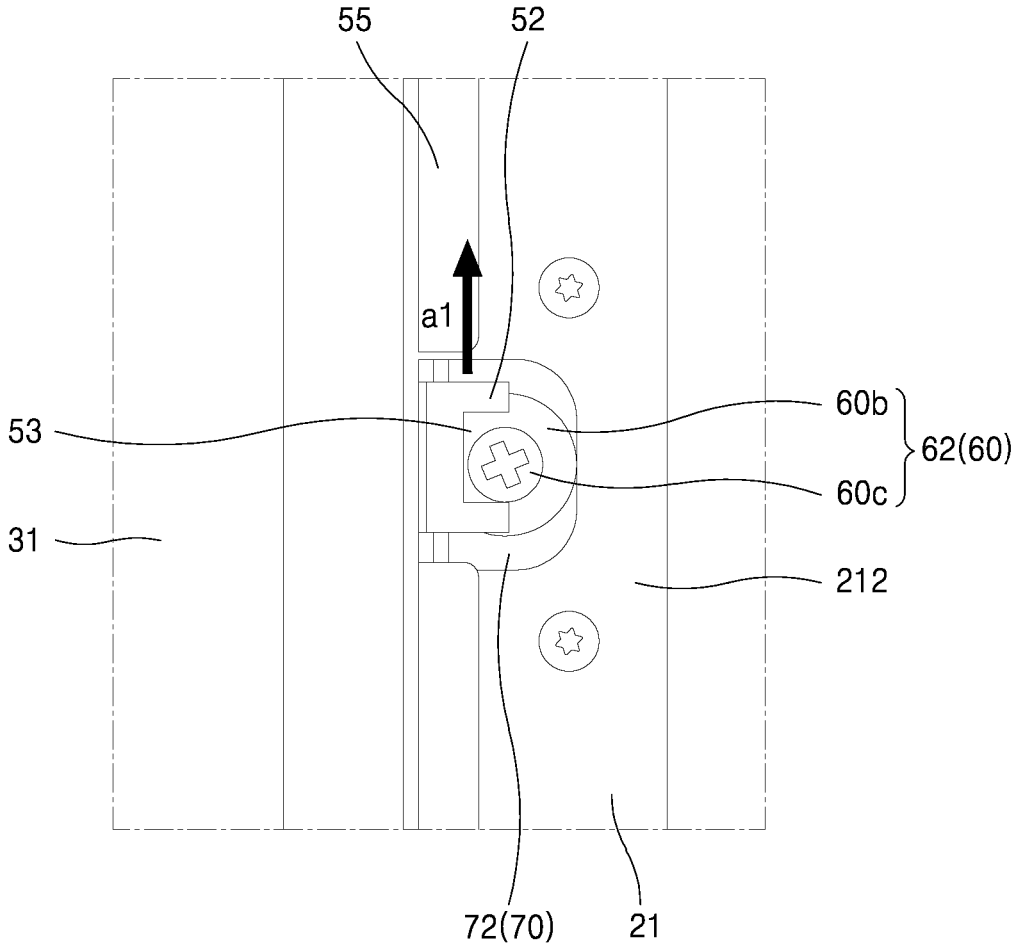
FIG. 14 is a side view showing that the second fastening part sits on the second adjustment member, in the state where the door is moved upward.
Figure 15:
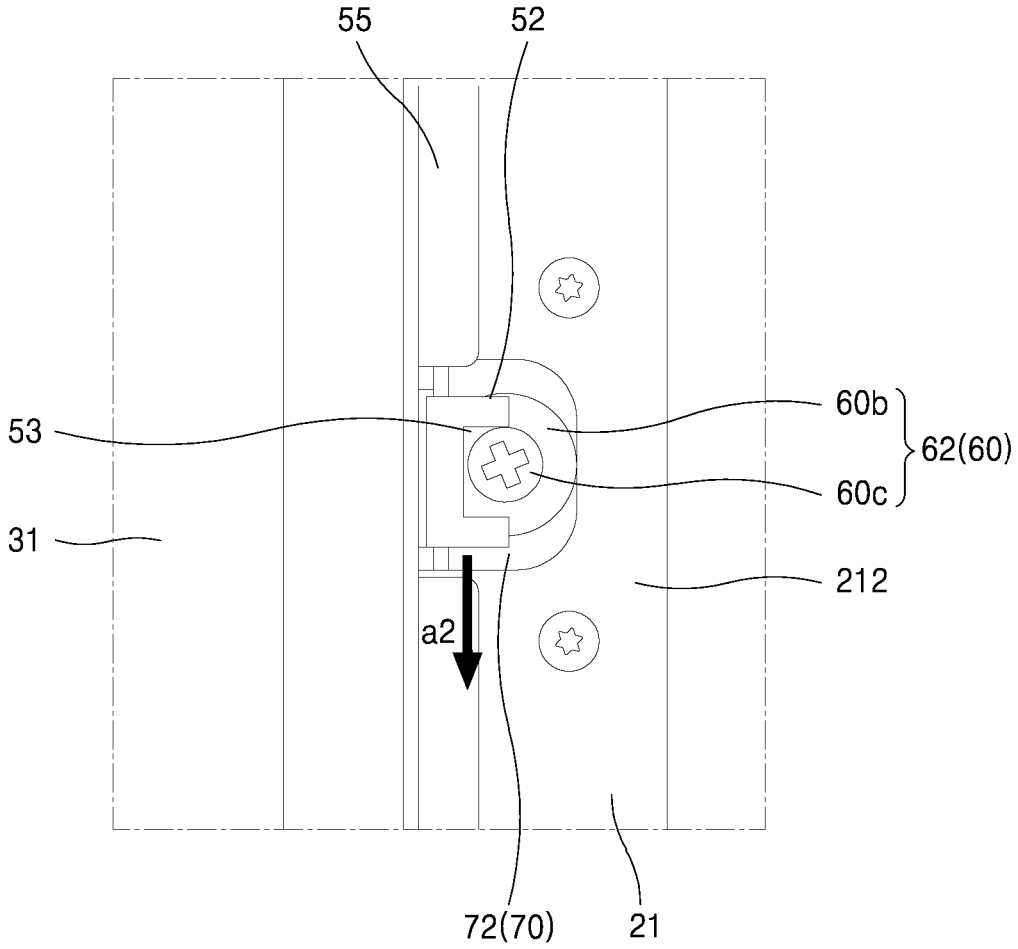
FIG. 15 is a side view showing that the second fastening part sits in/on the second adjustment member, in the state where the door is moved downward.
Figure 16:
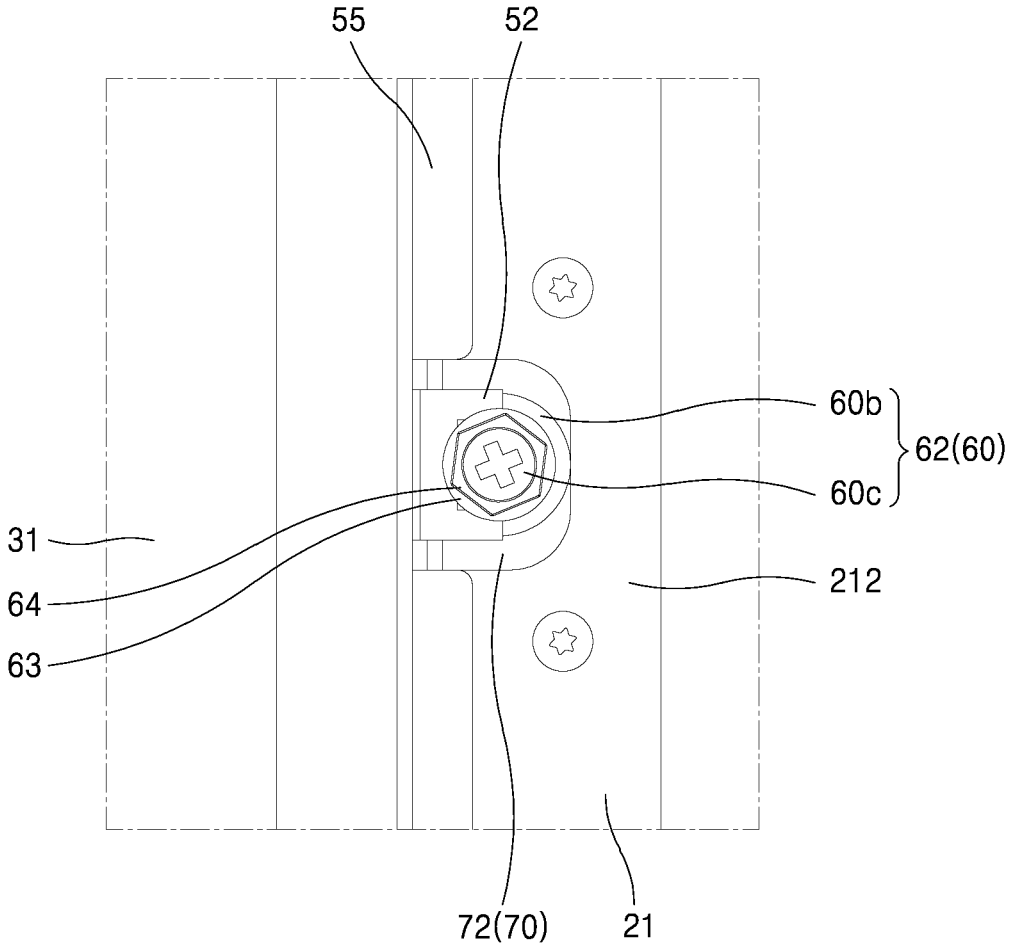
FIG. 16 is a side view showing that a nut is assembled to the second adjustment member, such that the second fastening part is fixed to the second adjustment member.
Figure 17:
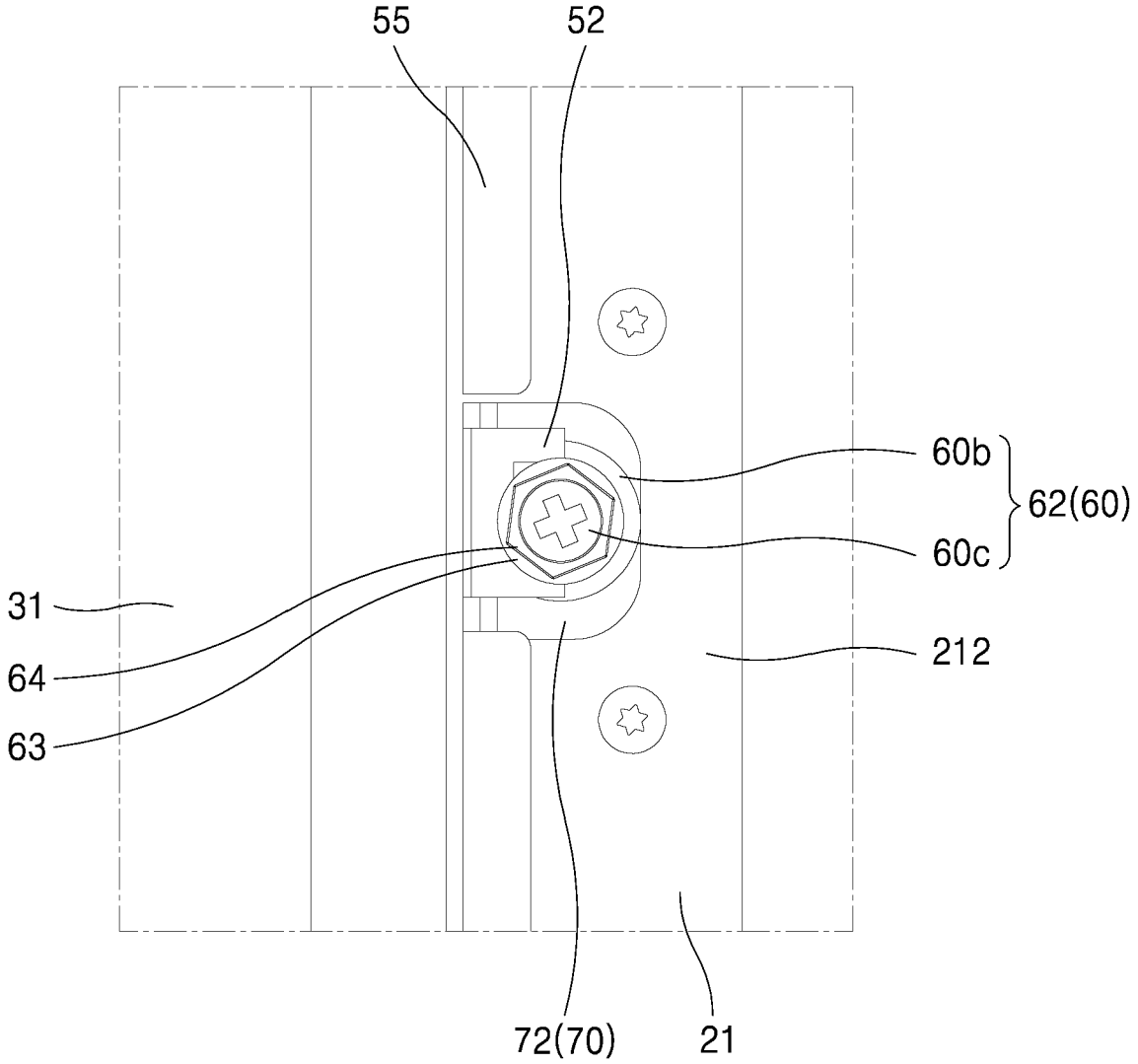
FIG. 17 is a side view showing that a nut is assembled to the second adjustment member, in the state where the door is moved upward, such that the second fastening part is fixed to the second adjustment member.
Figure 18:
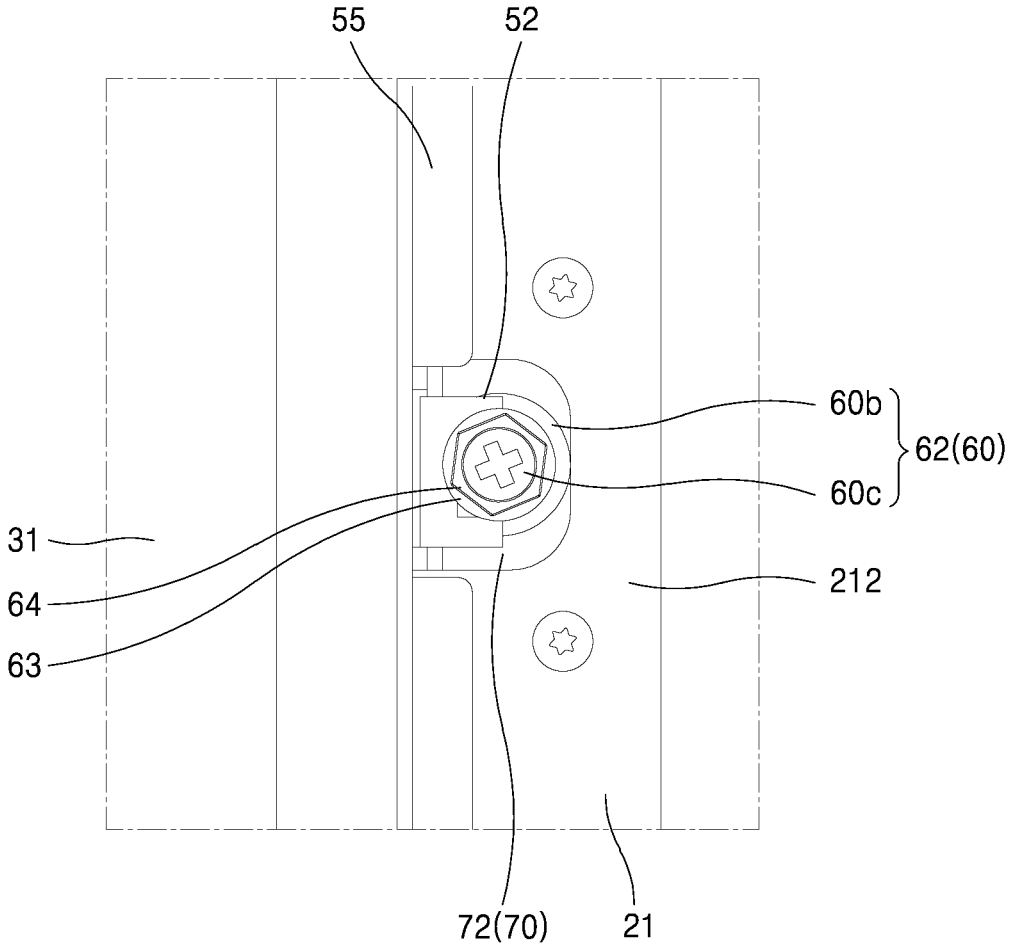
FIG. 18 is a side view showing that a nut is assembled to the second adjustment member, in the state where the door is moved downward, such that the second fastening part is fixed to the second adjustment member.

Since the outer diameter of the tightening part 60*c* is less than the inner diameter of the insertion part 53, the tightening part 60*c* may move in the upward direction (a1) or the downward direction (a2), in the insertion part 53, as illustrated in FIGS. 14 and 15.

At this time, a direction of movement of the second fastening part 52 may be determined substantially depending on the movement of the first fastening part 42 disposed on the upper surface 211 of the door 21.

Additionally, the second fastening part 52 may also move in the left-right direction (b) and the front-rear direction (c).

The left-right (b) movement of the second fastening part 52 may be adjusted based on the rotation direction of the adjusting part 60*a* of the second adjustment member 62 and the number of rotations of the adjusting part 60*a* of the second adjustment member 62.

Further, since the rear surface of the insertion part 53 of the second fastening part 52 is open, the forward movement of the second adjustment member 62 may be restricted while the rearward movement of the second adjustment member 62 is not restricted.

However, to ensure the verticality of the panel 31, the second adjustment member 62 may synchronize with the front-rear (c) movement position of the first adjustment member 61 disposed on the upper surface 211 of the door 21.

To this end, the tightening part 60*c* of the second adjustment member 62 may preferably move in the front-rear direction, such that at least a portion of the tightening part 60*c* of the second adjustment member 62 overlaps the insertion part 53 of the second fastening part 52 in the up-down direction.

Figure 19:
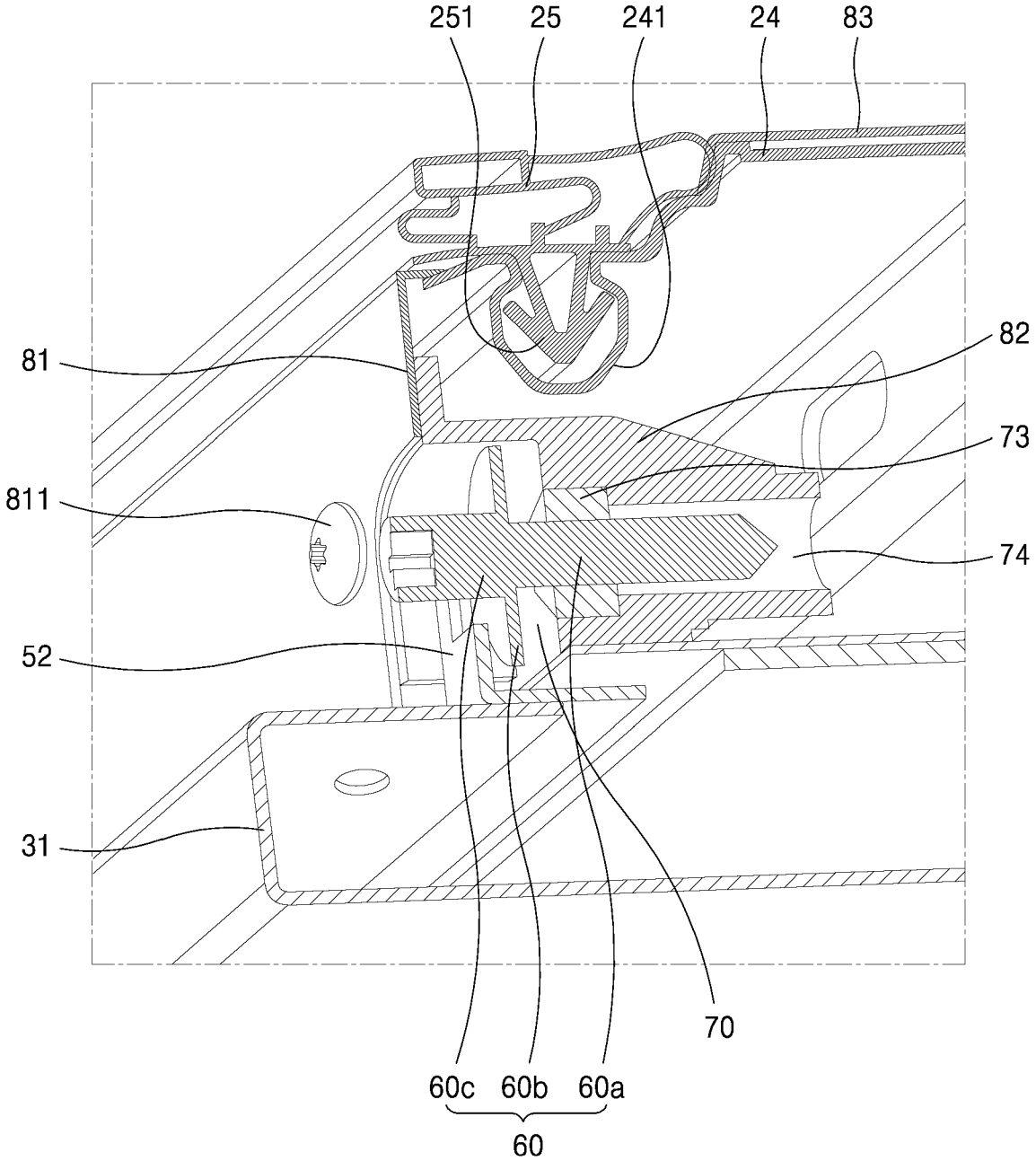
FIG. 19 is a lateral cross-sectional view that the second fastening part is not yet fixed to the second adjustment member.
Figure 20:
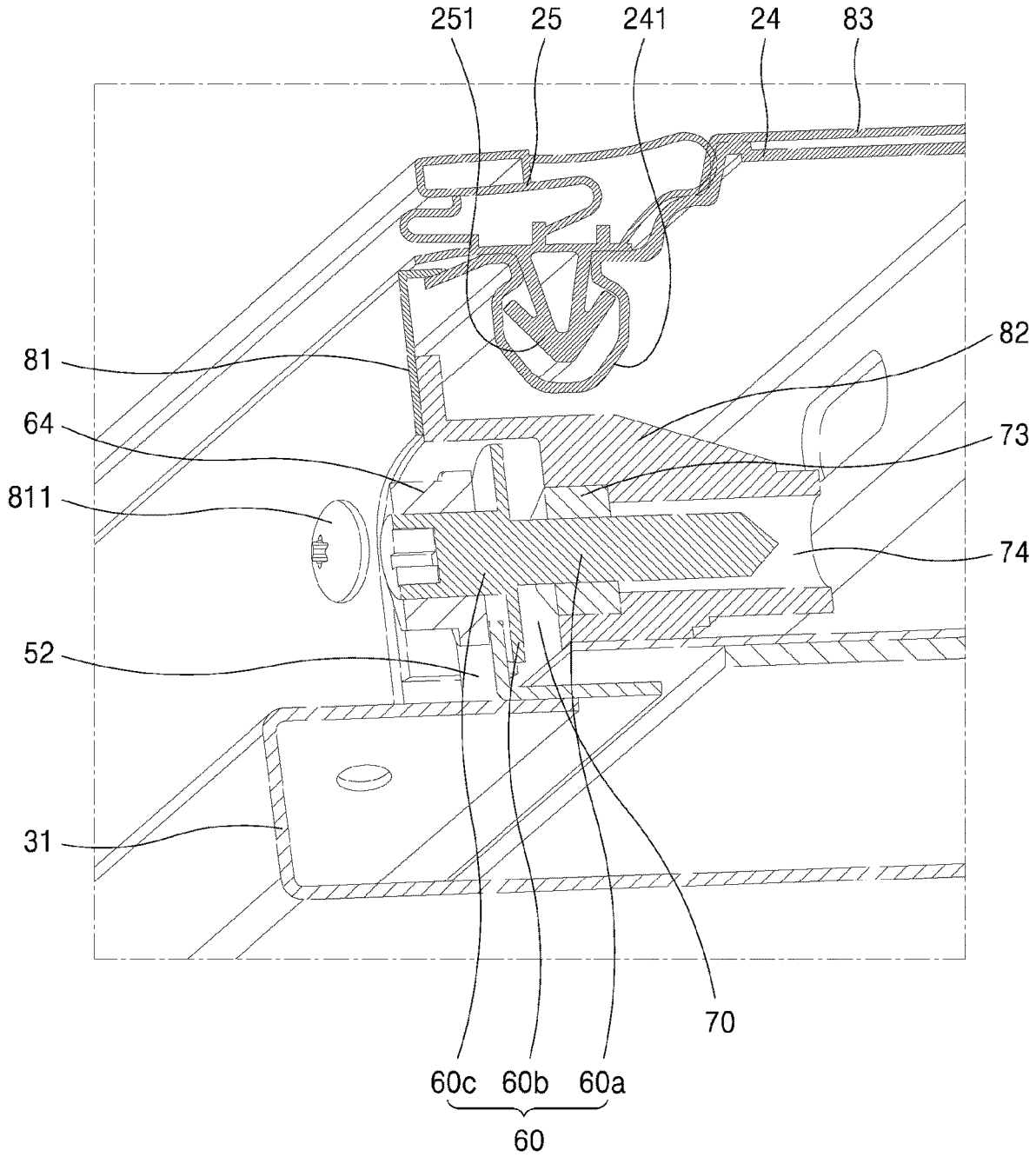
FIG. 20 is a lateral cross-sectional view showing that a nut is assembled to the second adjustment member, such that the second fastening part is fixed to the second adjustment member.

FIG. 19 is a lateral cross-sectional view showing a lateral surface 212 of the door 21.

A gasket groove 241 may be formed in the edge portion of the rear surface of a door liner 24 disposed at the rear of the door 21, and a gasket mounting part 251 of a gasket 25 may be inserted into and fixed to the gasket groove 241.

A deco panel 83 may be coupled to and may form the rear surface of the door liner 24 and, and a side cover 81 may be coupled to and may form the lateral surface of the door liner 24.

A supporter 82 may be disposed inside the side cover 81 and improve the rigidity of the door 21, and the side cover 81 may be fixed to the supporter 82 by a plurality of coupling members 811.

A concave part 70 may be formed at the supporter 82, and the adjustment member 60 may be coupled to the concave part 70.

An insertion hole 74 may be formed at the concave part 70, and the fastening hole 73 may be inserted into the insertion hole 74. The adjusting part 60*a* of the adjustment member 60 may be inserted into the fastening hole 73, based on a screw coupling.

To adjust the left-right movement of the second fastening part 52 freely, the adjusting part 60*a* of the adjustment member 60 may be moved sufficiently toward the inside of the door 21 such that the second fastening part 52 is spaced a predetermined distance apart from the mounting part 60*b* of the adjustment member 60.

As the panel 31 moves in the left-right direction in the state where the adjusting part 60*a* is moved as described above, the second fastening part 52 may move.

Further, for a precise movement of the panel 31, the adjusting part 60*a* rotates in the state where the mounting part 60*b* contacts the second fastening part 52, such that the mounting part 60*b* moves bit by bit in a way that the mounting part 60*b* presses the second fastening part 52.

Since the tightening part 60*c* is screw-coupled to the washer 63 by the nut 64 as illustrated in FIGS. 16, 17, 18 and 20, after the up-down (a), left-right (b) and front-rear (c) positions of the panel 31 are adjusted, the second fastening part 52 and the second adjustment member 62 are fixedly coupled, and the panel 31 may be fixed to a lateral surface 212 of the door 21.

Specifically, after the position of the panel 31 is adjusted, the adjusting part 60*a* may rotate until the mounting part 60*b* of each of the second adjustment members 62 disposed on both the lateral surfaces 212 of the door 21 contacts the second fastening part 52.

Since the washer 63 and the nut 64 are screw-coupled to the tightening part 60*c* in the state where the mounting part 60*b* of each of the second adjustment members 62 disposed on both the lateral surfaces 212 of the door 21 contacts one surface of the second fastening part 52, the other surface of the second fastening part 52 may contact and be fixed to the washer 63.

In the refrigerator 1 of the present disclosure, the outer diameter of the tightening part 60*c* the adjustment member 60 is less than the inner diameter of the insertion part 53 of the second fastening part 52, providing a margin in which the panel 31 can move in the front-rear direction, such that a front-rear movement mechanism for adjusting a step is simplified.

Additionally, in the refrigerator 1 of the present disclosure, an interaction between the first adjustment member 61 and the first fastening part 42 disposed on the upper surface 211 of the door 21 may result in an adjustment of a front-rear step in the upper area of the panel 31, and an interaction between the second adjustment member 62 and the second fastening part 52 disposed on the lateral surfaces 212 of the door 21 may result in an adjustment of a front-rear step in the lower area of the panel 31, such that a twist of the panel 31 the step of which is adjusted decreases with a simple structure.

Further, in the refrigerator 1 of the present disclosure, in the state where the first fastening part 42 of the first bracket 40 is coupled and primarily fixed to the first adjustment member 61 disposed on the upper surface 211 of the door 21, a step may be adjusted, and the panel may be fixed to the door, as the second fastening part 52 of the second bracket 50 is coupled to the second adjustment member 62 disposed on the lateral surfaces 212 of the door 21, thereby ensuring efficiency and workability in the adjustment of a step of the panel 31.

In particular, in the refrigerator 1 of the present disclosure, a simple screw adjustment of the two adjustment members 60 disposed on the upper surface 211 of the door 21 and the four adjustment members 60 disposed on both the lateral surfaces 212 of the door 21 may lead to an adjustment of up-down, left-right and front-rear steps of the panel 31, leading to a significant reduction in time taken to adjust a step and ensuring efficiency in the adjustment of a step.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiments.

What is claimed is:

1. A refrigerator, comprising:

a cabinet having a storage compartment;

a door configured to open and close a front surface of the cabinet;

a panel disposed on a front of the door;

a first adjustor disposed on the upper surface of the door; and a second adjustor respectively disposed on a first lateral surface and a second lateral surface of the door, and configured to adjust a left-right position of the panel relative to the door, wherein the second adjustor is screw-coupled to a lateral surface of the door and adjusted based on its rotation, and wherein the second adjustor comprises:

an adjusting part configured to rotate, a mounting part configured to support a fastener of a coupling bracket and to move based on rotation of the adjusting part, and a tightening part configured to be coupled with a nut to fix the fastener between the mounting part and the nut, wherein the coupling bracket is coupled to the panel, and is configured to attach the first and second adjustors to the panel, and wherein the first adjustor is configured to adjust a position of the panel relative to the door.

2. The refrigerator of claim 1, wherein the coupling bracket includes a first bracket disposed along an upper surface of the panel, and a pair of second brackets disposed along first and second lateral surfaces of the panel, the first bracket includes a first fastener extending rearward from the panel and having a surface that faces the upper surface of the door, and the first fastener is configured to be attached to the first adjustor, and the second bracket includes a second fastener extending rearward from the panel and having a surface that faces at least one of the lateral surfaces of the door, and the second fastener is configured to be attached to the second adjustor.

3. The refrigerator of claim 2, wherein the first fastener includes a penetration hole configured to allow part of the first adjustor to pass, and the second fastener includes an insertion component having an open surface to partially surround the second adjustor.

4. The refrigerator of claim 3, wherein the door includes a plurality of concave portions that include a fastening hole and having an open front surface, and the concave portions includes a first concave portion disposed on the upper surface of the door and the first concave portion to couple to the first adjustor, and a second concave portion disposed on the lateral surfaces of the door and the second concave portion to couple to the second adjustor.

5. The refrigerator of claim 4, wherein the first adjustor comprises:

a mounting part to support the first fastener;

an adjusting part being elongated from a first side of the mounting part of the first adjustor and configured to couple to a periphery of the fastening hole; and a tightening part being elongated from a second side of the mounting part of the first adjustor and configured to penetrate the first fastener, wherein an up-down position or a left-right position of the panel is adjusted based on rotation of the adjusting part of the first adjustor.

6. The refrigerator of claim 3, wherein a distance moved by the tightening part penetrating the first fastener is limited by the penetration hole, and a distance moved by the tightening part penetrating the second fastener is limited by the insertion component.

7. The refrigerator of claim 4, wherein an inner diameter of the first concave portion is greater than an outer diameter of the first fastener, and an inner diameter of the second concave portion is greater than an outer diameter of the second fastener.

8. The refrigerator of claim 3, wherein an outer diameter of the tightening part is less than an inner diameter of the penetration hole, and the outer diameter of the tightening part is less than an inner diameter of the insertion component.

9. The refrigerator of claim 5, comprising a nut to be screw-coupled to the tightening part of the first adjustor, and a first washer that is disposed between the mounting part of the first adjustor and the nut.

10. The refrigerator of claim 1, wherein a pair of the first adjustor are disposed on the upper surface of the door, and a pair of the second adjustor are respectively disposed on both of the lateral surfaces of the door.

11. The refrigerator of claim 10, wherein the pair of the first adjustors are disposed respectively on both sides of the upper surface of the door, with respect to a center thereof, in a left-right direction thereof, and the pair of the second adjustors are disposed respectively on both of the lateral surfaces of the door, with respect to a center thereof, in an up-down direction thereof.

12. The refrigerator of claim 1, wherein the first adjustor is to couple to the door such that the first adjustor is to move the panel in an up-down direction of the door, and the second adjustor is to couple to the door such that the second adjustor is to move the panel in a left-right direction of the door.

13. A refrigerator, comprising:

a door configured to open and close relative to a body;

a panel disposed on a front of the door;

a first bracket coupled to an upper surface of the panel;

a second bracket coupled to a first lateral surface of the panel;

a first adjustor disposed on an upper surface of the door; and a second adjustor respectively disposed on a first lateral surface of the door and a second lateral surface of the door, and configured to be screw-coupled to a lateral surface of the door and adjusted based on its rotation, wherein the second adjustor comprises:

an adjusting part configured to rotate, a mounting part configured to support a fastener of the second bracket and to move based on rotation of the adjusting part, and a tightening part configured to be coupled with a nut to fix the fastener between the mounting part and the nut, the first bracket is to couple to the first adjustor and the first adjustor is configured to adjust the panel relative to the door in a first direction or a second direction opposite to the first direction, and the second bracket is to couple to the second adjustor and the second adjustor is configured to adjust the panel relative to the door in a third direction transverse to the first direction or a fourth direction opposite to the third direction, which corresponds to a left-right direction.

14. The refrigerator of claim 13, wherein a pair of the first adjustor are disposed on the upper surface of the door, and a pair of the second adjustor are respectively disposed on the first lateral surface and a second lateral surface of the door.

15. The refrigerator of claim 14, wherein the pair of the first adjustors are disposed respectively on both sides of the upper surface of the door, with respect to a center thereof, in a left-right direction thereof, and the pair of the second adjustors are disposed respectively on both of the lateral surfaces of the door, with respect to a center thereof, in an up-down direction thereof.

16. The refrigerator of claim 13, wherein the first adjustor is to couple to the door such that the first adjustor is to move the panel in an up-down direction of the door, and the second adjustor is to couple to the door such that the second adjustor is to move the panel in a left-right direction of the door.

17. The refrigerator of claim 13, wherein the first adjustor comprises:

a mounting part to support the first fastener;

an adjusting part being elongated from a first side of the mounting part of the first adjustor and configured to couple to a periphery of a hole of the door; and a tightening part being elongated from a second side of the mounting part of the first adjustor and configured to penetrate the first fastener, wherein position of the panel is adjusted based on rotation of the adjusting part of the first adjustor.

18. A refrigerator, comprising:

a body having an opening;

a door configured to open and close relative to the opening;

a panel disposed on a front of the door;

a first bracket coupled to an upper side of the panel;

a second bracket coupled to lateral sides of the panel;

a first adjustor disposed on an upper side of the door and configured to couple to the first bracket; and a second adjustor respectively disposed on first and second lateral sides of the door, screw-fastened to the lateral sides of the door, and configured to couple to the second bracket, wherein the second adjustor comprises:

an adjusting part configured to rotate, a mounting part configured to support a fastener of the second bracket and to move based on rotation of the adjusting part, and a tightening part configured to be coupled with a nut to fix the fastener between the mounting part and the nut, the first adjustor is configured such that the panel is to move relative to the door based on rotation of part of the first adjustor, and the second adjustor is configured to such that the panel is to move relative to the door in a left-right direction based on rotation of part of the second adjustor.

19. The refrigerator of claim 18, wherein a pair of the first adjustor are disposed on the upper side of the door, and a pair of the second adjustor are respectively disposed on both of the lateral sides of the door, wherein the pair of the first adjustors are disposed respectively on both sides of the upper side of the door, with respect to a center thereof, in a left-right direction thereof, and the pair of the second adjustors are disposed respectively on both of the lateral sides of the door, with respect to a center thereof, in an up-down direction thereof.

* * * * *